US007420530B2

(12) United States Patent
Asano et al.

(10) Patent No.: US 7,420,530 B2
(45) Date of Patent: Sep. 2, 2008

(54) PIXEL CIRCUIT, DISPLAY DEVICE METHOD FOR CONTROLLING PIXEL CIRCUIT

(75) Inventors: Mitsuru Asano, Kanagawa (JP); Akira Yumoto, Kanagawa (JP); Hiroshi Fujimura, Aichi (JP)

(73) Assignee: Sony Corporation (JP)

( * ) Notice: Subject to any disclaimer, the term of this patent is extended or adjusted under 35 U.S.C. 154(b) by 147 days.

(21) Appl. No.: 11/416,120

(22) Filed: May 3, 2006

(65) Prior Publication Data

US 2006/0256058 A1 Nov. 16, 2006

(30) Foreign Application Priority Data

May 12, 2005 (JP) ..... 2005-139898

(51) Int. Cl.
*G09G 3/30* (2006.01)

(52) U.S. Cl. ..... 345/78; 345/82; 315/169.3

(58) Field of Classification Search ..... 315/169.3, 315/169.4, 169.1; 345/78, 92, 94, 82, 84, 345/204, 208–210
See application file for complete search history.

(56) References Cited

U.S. PATENT DOCUMENTS 5,684,365 A 11/1997 Tang
6,229,506 B1 5/2001 Dawson et al.
7,224,334 B2 * 5/2007 Choi et al. ..... 315/169.3
7,259,737 B2 * 8/2007 Ono et al. ..... 345/82
2006/0044244 A1 * 3/2006 Numao ..... 345/92
2006/0061560 A1 * 3/2006 Yamashita et al. ..... 345/204

FOREIGN PATENT DOCUMENTS

JP H08-234683 A 9/1996
JP 2002-514320 A 5/2002

* cited by examiner

*Primary Examiner*—Douglas W. Owens
*Assistant Examiner*—Ephrem Alemu
(74) *Attorney, Agent, or Firm*—Rader Fishman & Grauer PLLC; Ronald P. Kananen

(57) ABSTRACT

A pixel electrode and a display device capable of lowering power consumption with a uniformity of luminance retained, and realizing a display image having a high contrast and a high image quality, wherein a correction period for correcting a variation in properties of a drive transistor in a pixel during a frame, a write period for driving a first switch by a first control line and writing a data signal from a signal line to the node, and a drive period for storing the written data signal and driving an electro-optical element, are set, and the drive is controlled so that an interval having the correction period, the write period, and the drive period, and an interval having the write period and the drive period without the correction period exist.

19 Claims, 28 Drawing Sheets

PRIOR ART

PRIOR ART

PRIOR ART

HORIZONTAL SELECTION PERIOD
AUTO ZERO
DATA WRITE
LIGHT EMISSION

DRVL

AZL

SCNL

SGL
REFERENCE POTENTIAL (Vref)
⊿Vdata

Vg (TFT21)
VDD - |Vth|
⊿Vg

CORRECTION
NON-CORRECTION

CORRECTION STATE OF PIXEL CIRCUIT AT L-TH FRAME

CORRECTION STATE OF PIXEL CIRCUIT AT (L+1)-TH FRAME

CORRECTION STATE OF PIXEL CIRCUIT AT (L+2)-TH FRAME
SGL101-1
SGL101-3
SGL101-n-1
SGL101-n
SGL101-2
SGL101-4
SCNL101-1
SCNL101-2
SCNL101-3
SCNL101-4
SCNL101-m-1
SCNL101-m

CORRECTION
NON-CORRECTION

CORRECTION STATE OF PIXEL CIRCUIT AT L-TH FRAME

CORRECTION STATE OF PIXEL CIRCUIT AT (L+1)-TH FRAME

CORRECTION STATE OF PIXEL CIRCUIT AT (L+2)-TH FRAME
SGL101-1
SGL101-3
SGL101-n-1
SGL101-2
SGL101-4
SGL101-n
SCNL101-1
SCNL101-2
SCNL101-3
SCNL101-4
SCNL101-m-1
SCNL101-m
m : EVEN NUMBER)

CORRECTION
NON-CORRECTION

CORRECTION STATE OF PIXEL CIRCUIT AT L-TH FRAME

CORRECTION STATE OF PIXEL CIRCUIT AT (L+1)-TH FRAME

CORRECTION STATE OF PIXEL CIRCUIT AT (L+2)-TH FRAME
SGL101-1
SGL101-3
SGL101-n-1
SGL101-n
SGL101-2
SGL101-4
SCNL101-1
SCNL101-2
SCNL101-3
SCNL101-4
SCNL101-m-1
SCNL101-m
m : EVEN NUMBER)
n : EVEN NUMBER)

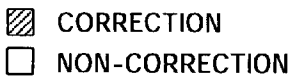
FIG. 17A
CORRECTION STATE OF PIXEL CIRCUIT AT L-TH FRAME
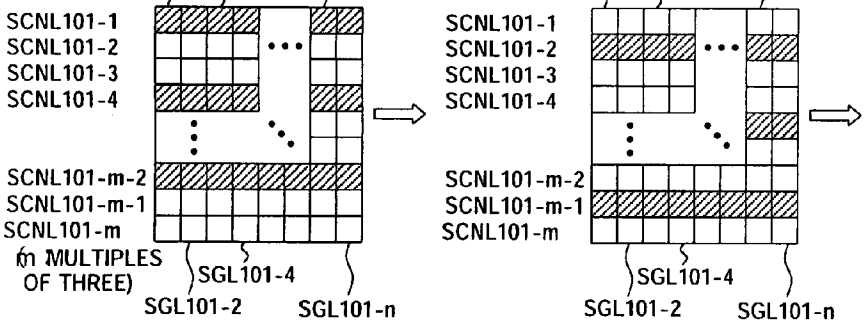
FIG. 17B
CORRECTION STATE OF PIXEL CIRCUIT AT (L+1)-TH FRAME
FIG. 17C
CORRECTION STATE OF PIXEL CIRCUIT AT (L+2)-TH FRAME
FIG. 17D
CORRECTION STATE OF PIXEL CIRCUIT AT (L+3)-TH FRAME

PIXEL CIRCUIT, DISPLAY DEVICE METHOD FOR CONTROLLING PIXEL CIRCUIT

CROSS REFERENCES TO RELATED APPLICATIONS

The present invention contains subject matter related to Japanese Patent Application No. 2005-139898 filed in the Japanese Patent Office on May 12, 2005, the entire contents of which being incorporated herein by reference.

BACKGROUND OF THE INVENTION

1. Field of the Invention

The present invention relates to a pixel circuit having an electro-optical element in which a luminance is controlled by a signal line, a display device, such as an organic EL (electroluminescence) display, an LCD (liquid crystal display) device, or other active matrix display device, in which a plurality of the pixel circuit is arranged in matrix, and a method for controlling the pixel circuit.

2. Description of the Related Art

In the active matrix display device, a liquid crystal cell, an organic EL element, or other electro-optical elements is used as a display element in a pixel.

Among them, the organic EL element has a structure in which a layer made of an organic material, namely an organic layer, is sandwiched between electrodes.

When the organic EL element is applied with a voltage, electrons are injected from a cathode into the organic layer and holes are injected from an anode into the same, as a result, electrons and holes are re-coupled to emit light. The organic EL element has the following merits.

(1) A luminance of several 100 to several 10,000 cd/$m^2$ is obtained by driving at a low voltage of 10 V or less, so a low power consumption is possible.

(2) A contrast of an image is high due to a self-luminescence element and the response speed is fast, so a viewability is good and the element is suitable for a moving image display.

(3) The element is formed by an all solid state element having a simple structure, so a high reliability and thinness of the element can be realized.

An organic EL display device (hereinafter, referred to as organic EL display) in which the organic EL element having the above merits is used as the display element of a pixel, has been gathered attention as a next generation flat panel display.

As a drive system of the organic EL display, there are a simple matrix system and an active matrix system. In the above systems, the active matrix system has the following merits.

(1) The active matrix system by which an emitting light of the organic EL element each in a pixel is able to be retained during a single frame period, is suitable for a high definition and a high intensity of an organic EL display.

(2) A peripheral circuit used a thin film transistor is able to be formed on a substrate (panel), so an interface of the panel to an external can be simplified and a high function panel is possible.

In the active matrix organic EL display, a thin film transistor (hereinafter, referred to polysilicon TFT) having an active layer formed by polycrystalline silicon is generally used as a transistor of an active element.

This is because the polysilicon TFT has a high drivability and a pixel size can be designed to be small, which are advantageous to a high definition.

On the other hand, it is known that polysilicon TFT has a large variation of properties while having the merits described above.

Therefore, when the polysilicon TFT is used, suppressing the variation of property and compensating the variation of property of the TFTs by a circuit are considerable disadvantages for the active matrix organic EL display used with the polysilicon TFT. This is because of the following reason.

Namely, while a liquid crystal display used with a liquid crystal cell as the display element in the pixel adopts a configuration for controlling a luminance data each in the pixel by a voltage value, the organic EL display adopts a configuration for controlling the same by a current value.

A schema of the active matrix organic EL display will be described.

FIG. 1 is a schematic view illustrating a configuration of a general active matrix organic EL display, and FIG. 2 is a circuit diagram illustrating a configuration example of a pixel circuit of the active matrix organic EL display (for example, referred to U.S. Pat. No. 5,684,365 and Japanese Unexamined Patent Application (Kokai) No. 8-234683).

In an active matrix organic EL display 1, an m×n number of pixel circuit 10 is arranged in matrix, and, with respect to a matrix arrangement of the pixel circuit 10, an n number of row's worth of signal lines SGL1 to SGLn driven by a data driver (DDRV) 2 is interconnected in each pixel row and an m number of columns of scan lines SCNL1 to SCNLm driven by a scan driver (SDRV) 3 is interconnected in each pixel column.

The pixel circuit 10 has a p-channel TFT 11, an n-channel TFT 12, a capacitor C11, and a light emitting element 13 formed by an organic EL element (OLED) as shown in FIG. 2.

In the TFT 11 of the pixel circuit 10, a source is connected to a power source potential line VCCL and a gate is connected to a drain of the TFT 12. In the organic EL light emitting element 13, an anode is connected to a drain of the TFT 11 and a cathode is connected to a reference potential (for example, a grand potential) GND.

In the TFT 12 of the pixel circuit 10, a source is connected to one of the signal line SGL1 to SGLn of a corresponding row, and a gate is connected to one of the scan lines SCNL1 to SCNLm of a corresponding column.

In the capacitor C11, an end is connected to the power source potential line VCCL and another end is connected to the drain of the TFT 12.

Note that, the organic EL element usually has a rectification property in many cases, so sometimes is called as an organic light emitting diode (OLED). Although FIG. 2 or other drawings illustrate the light emitting element by using a symbol of a diode, the rectification property may be not demanded to the OLED in the following explanation.

In the pixel circuit 10 having the above configuration, a pixel row including a pixel in which the luminance data is written is selected by the scan driver 3 via the scan line SCNL, as a result, the TFT 12 of the pixel in the row is turned on.

At this time, the luminance data is supplied as a voltage from the data driver 2 via the signal line SGL, and is written via the TFT 12 into the capacitor C11 for holding a data voltage.

The luminance data written into the capacitor C11 is held during a single field period. The held data voltage is applied to the gate of the TFT 11.

Therefore, the TFT 11 drives the organic EL light emitting element 13 by current based on the held data. At this time, a gray-scale display of the organic EL light emitting element 13 is carried out by modulating a gate-source voltage Vdata (<0) of the TFT 11 held by the capacitor C11. a Generally, a luminance Loled of the organic EL element is proportional to a current Ioled flowing therein. Therefore, a relationship between the luminance Loled and the current Ioled of the organic EL light emitting element 13 is expressed by the following formula (1).

$$\text{Loled} \propto \text{Ioled} = k(\text{Vdata} - \text{V}th)^2 \quad (1)$$

In the above formula (1), "k=½·μ·Cox·W/L" stands. Here, "μ" indicates a mobility of a carrier of the TFT 11, "Cox" indicates a gate capacitance per unit area of the TFT 11, "W" indicates a gate width of the TFT 11, and "L" indicates a gate length of the TFT 11.

Therefore, it is understood that each variation of the mobility μ and a threshold voltage Vth (<0) of the TFT 11 directly influences a variation of a luminance of the organic EL light emitting element 13.

In this case, when the same voltage Vdata for example is written into different pixels, the threshold Vth of the TFT 11 varies each in the pixel, as a result, the current Ioled flowing into the light emitting element (OLED) 13 largely varies each in the pixel and then the current is completely off the desirable value, so a high image quality may not be expected as a display.

To overcome the above disadvantages, various pixel circuits have been proposed and a typical example is illustrated in FIG. 3 (another example, refer to U.S. Pat. No. 6,229,506 or Japanese Unexamined Patent Application (Kokai) No. 2002-514320 of FIG. 3).

A pixel circuit 20 shown in FIG. 3 has a p-channel TFTs 21, to 24, capacitors C21 and C22, and an organic EL light emitting element 25 as the light emitting element. In FIG. 3, "SGL" indicates a signal line, "SCNL" indicates a scan line, "AZL" indicates an auto-zero line, and "DRVL" indicates a drive line.

An operation of the pixel circuit 20 will be explained with reference to timing charts illustrated in FIGS. 4A to 4E.

As shown in FIGS. 4A and 4B, the drive line DRVL and the auto-zero line AZL are set at a low level to make the TFT 22 and the TFT 23 conductive states. At this time, the TFT 21 with a diode connected is connected to the light emitting element (OLED) 25, so a current flows into the TFT 21.

As shown in FIG. 4A, the drive line DRVL is set at a high level to make the TFT 22 a non-conductive state. At this time, the scan line SCNL is set at the low level shown in FIG. 4C to make the TFT 24 the conductive state, and the signal line SGL is applied with a reference potential Vref shown in FIG. 4D. The current flowing into the TFT 21 is cut off, so a gate potential Vg of the TFT 21 rises, as shown in FIG. 4E. At the point where the gate potential Vg rises up to "VDD−|Vth|", the TFT 21 is turned off and the potential is stabilized. The above operation is also referred to as an "auto-zero operation" in the following.

As shown in FIGS. 4B and 4D, the auto-zero line AZL is set at the high level to make the TFT 23 the non-conductive state, as a result, a potential of the signal line SGL falls at "ΔVdata" from "Vref". A change of the signal line potential lowers the gate potential of the TFT 21 at "ΔVg" via the capacitor C21 as shown in FIG. 4E.

As shown in FIGS. 4A and 4C, the scan line SCNL is set at the high level to make the TFT 24 the non-conductive state and the drive line DRVL is set at the low level to make the TFT 22 the conductive state. As a result, the current flows into the TFT 21 and the light emitting element (OLED) 25, and then the light emitting element 25 starts to emit light.

If a parasitic capacitance can be disregard, "ΔVg" and the gate potential Vg of the TFT 21 are expressed by the following formulas.

$$\Delta\text{V}g = \Delta\text{Vdata} \times \text{C1}/(\text{C1}+\text{C2}) \quad (2)$$

$$\text{V}g = \text{V}cc - |\text{V}th| - \Delta\text{Vdata} \times \text{C1}/(\text{C1}+\text{C2}) \quad (3)$$

Here, "C1" indicates a capacitance of the capacitor C21, and C2" indicates a capacitance of the capacitor C22.

On the other hand, when a current flowing into the light emitting element (OLED) 25 as emitting light is defined as "Ioled", the current is controlled by the TFT 21 connected to the light emitting element 25 in serial. If it is assumed that the TFT 21 operates in a saturate region, the following relationship is obtained by applying a well-known formula of the MOS transistor and the above formula (3).

$$\begin{aligned} Ioled &= \mu\text{Cox}W/L/2\ (Vcc - Vg - |Vth|)^2 \\ &= \mu\text{Cox}W/L/2\ (\Delta Vdata \times C1/(C1+C2))^2 \end{aligned} \quad (4)$$

Here, "μ" indicates the mobility of a carrier, "Cox" indicates a gate capacitance per a unit area, "W" indicates a gate width, and "L" indicates a gate length.

According to the formula (4), "Ioled" does not depend on the threshold Vth of the TFT 21 and is controlled by "ΔVdata" given from an external. In other words, by using the pixel circuit 20 shown in FIG. 3, a display device having relatively high uniformity both current and in luminance can be realized without being affected by the threshold Vth varying each in the pixels.

SUMMARY OF THE INVENTION

As described above, as a method for reducing the variation of the luminance each in the pixel of the organic EL display, a pixel circuit by which the variation of property of each drive transistor determining a current for driving the organic EL element is corrected, has been proposed.

The above circuit, as shown in FIG. 5, usually has a correction period for correcting the variation of property of the drive transistor, a write period for writing a data signal from a signal line to a pixel circuit, and a drive period for holding the written data signal into the pixel circuit and driving an electro-optical element, during a single frame.

Although the proposed pixel circuit retains a uniformity in luminance by setting the correction period in each frame in this way, and the circuit also performs a charge or discharge during the correction period, which causes the situation in which power consumption thereof may not able to be disregarded.

In some pixel circuits employing a correction circuit system, the organic EL element emits light during the correction period, but the correction period causes a reduction of contrast in those circuits.

The present invention is to provide a pixel circuit and a display device capable of a low power consumption with the uniformity of luminance retained, and for realizing a high contrast and a high image quality, and a method for controlling the pixel circuit.

According to a first aspect of an embodiment of the present invention, there is provided a pixel circuit having an electro-optical element changing a luminance based on a flowing current, a signal line supplied with a data signal corresponding to at least a luminance information; a first control line; a drive transistor forming a current supply line between a first terminal and a second terminal and controlling a current, flowing into the current supply line, based on a potential of a control terminal; a node electrically couplable to the control terminal of the drive transistor; and a first switch connected between the signal line and the node and controlled with a conductive state and a non-conducive state by the first control line, wherein during a frame, the circuit is able to set a correction period for correcting a variation of property of the drive transistor in a pixel, a write period for driving the first switch by the first control line and writing the data signal from the signal line to the node, and a drive period for storing the written data signal and driving the electro-optical element, and the circuit is driven and controlled so that an interval having the correction period, the write period, and the drive period are carried out, and an interval, having the write period and the drive period without the correction period exist.

Preferably, a coupling capacitance is connected between the node and the control terminal of the drive transistor, and a voltage depending on a threshold voltage of the drive transistor is charged during the correction period at a both ends of the coupling capacitance.

According to a second aspect of an embodiment of the present invention, there is provided a display device having a plurality of a pixel circuit arranged in matrix; a signal line interconnected in each column with respect to a matrix arrangement of the pixel circuit and supplied with a data signal corresponding to at least a luminance information; a first control line interconnected in each row with respect to a matrix arrangement of the pixel circuit; and a drive unit, the pixel circuit including an electro-optical element changing a luminance based on a flowing current, a signal line supplied with the data signal corresponding to at least the luminance information, a drive transistor forming a current supply line between a first terminal and a second terminal and controlling a current, flowing into the current supply line, based on a potential of a control terminal, a node electrically couplable to the control terminal of the drive transistor, and a first switch connected between the signal line and the node and controlled with a conductive state and a non-conductive state by the first control line, wherein during a frame, the drive is able to set a correction period for correcting a variation of property of the drive transistor in a pixel, a write period for driving the first switch by the first control line and writing the data signal from the signal line to the node, and a drive period for storing the written data signal and driving the electro-optical element, and the drive unit drives and controls so that an interval having the correction period, the write period, and the drive period are carried out, and an interval having the write period and the drive period without the correction period exist.

According to a third aspect of an embodiment of the present invention, there is provided a method for driving a pixel circuit, having an electro-optical element changing a luminance based on a flowing current, a signal line supplied with a data signal corresponding to at least a luminance information, a first control line, a drive transistor forming a current supply line between a first terminal and a second terminal and controlling a current, flowing into the current supply line, based on a potential of a control terminal, a node capable of electrically coupling the control terminal of the drive transistor, and a first switch connected between the signal line and the node and controlled with a conductive state by the first control line, the method having the step of controlling so that a correction period for correcting a variation of property of the drive transistor in a pixel, a write period for driving the first switch by the first control line and writing the data signal from the signal line to the node, and a drive period for storing the written data signal and driving the electro-optical element are set during a frame, and an interval having the correction period, the write period, and the drive period, and an interval having the write period and the drive period without the correction period exist.

Preferably, the correction period is set once per a plurality of the frame.

Preferably, the correction period is set once per a plurality of a field.

Preferably, an existence of the correction period is controlled in a plurality of row units.

Preferably, an existence of the correction period is controlled each in an odd numbered scan line unit and an even numbered scan line unit.

Preferably, an existence of the correction period is controlled in a plurality of column units.

Preferably, an existence of the correction period is controlled each in an odd numbered signal line unit and an even numbered signal line unit.

Preferably, an existence of the correction period is controlled in an adjoining pixel unit.

According to embodiments of the present invention, a single frame includes the correction period for correcting the variation of property of the drive transistor in the pixel, the write period for driving the first switch by the first control line and writing the data signal from the signal line into the node, and a drive period for holding the written data signal and driving the electro-optical element. While both of the write period and the drive period is carried out once per a frame, the correction period is carried out once per two or more frames, namely, a frame including the correction period, the write period, and the drive period, and a frame including the write period and the drive period and not including the correction period present.

BRIEF DESCRIPTION OF THE DRAWINGS

The above and other features of embodiments of the present invention will be apparent in more detail with reference to the accompanying drawings, in which:

FIGS. 17A to 17D are views for illustrating a fourth drive control method of the entire pixel array portion of the organic EL display having the pixel circuits in which an offset-channel correction in the fourth embodiment is performed;

DESCRIPTION OF THE PREFERRED EMBODIMENTS

Preferred embodiments according to the present invention will be described in more detail with reference to the drawings.

First Embodiment

Figure 6:
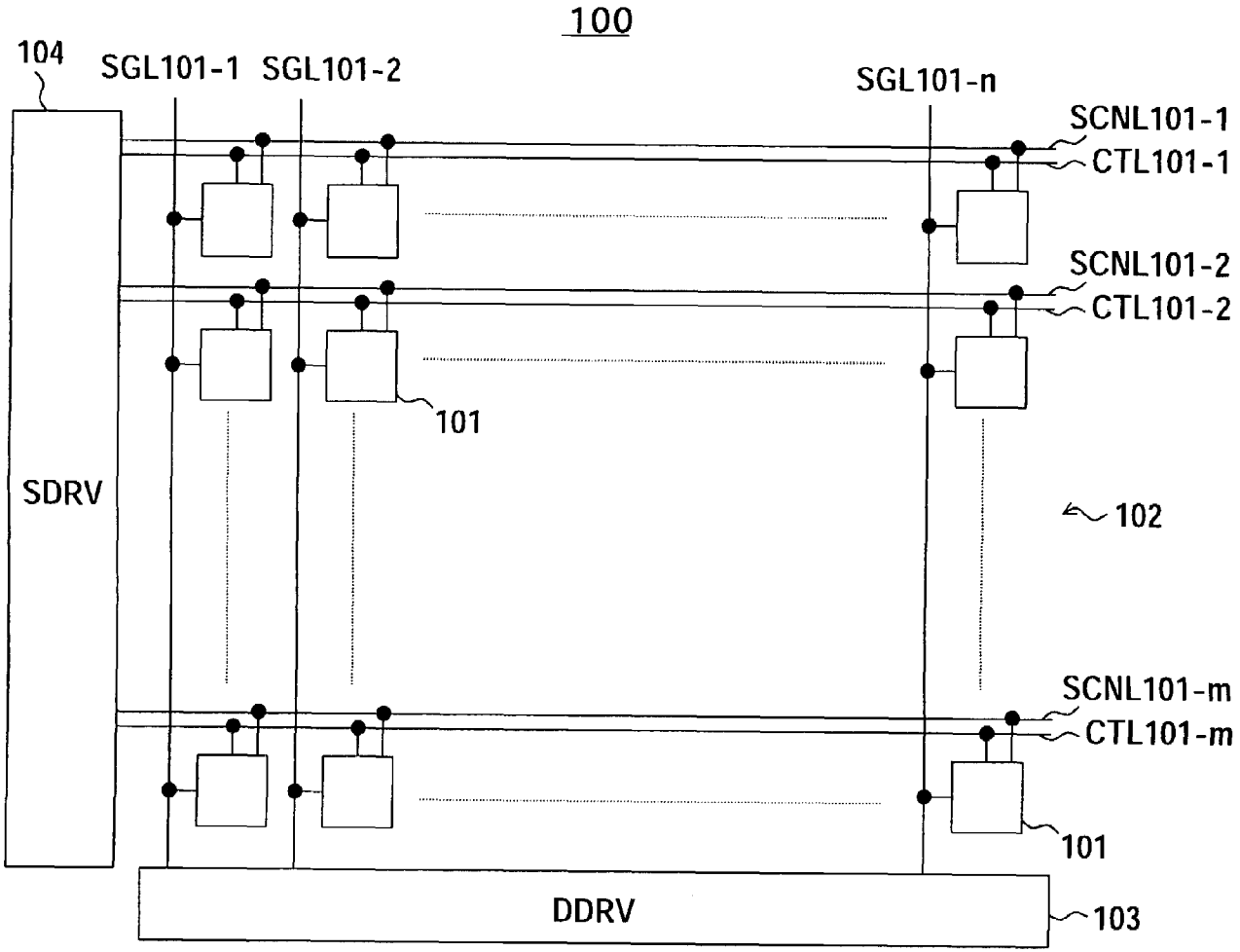
FIG. 6 is a block diagram illustrating a configuration of an active matrix organic EL display (display device) employing a pixel circuit according to a first embodiment.

FIG. 6 is a block diagram illustrating a configuration of an active matrix organic EL display (display device) employing a pixel circuit according to the first embodiment.

Figure 7:
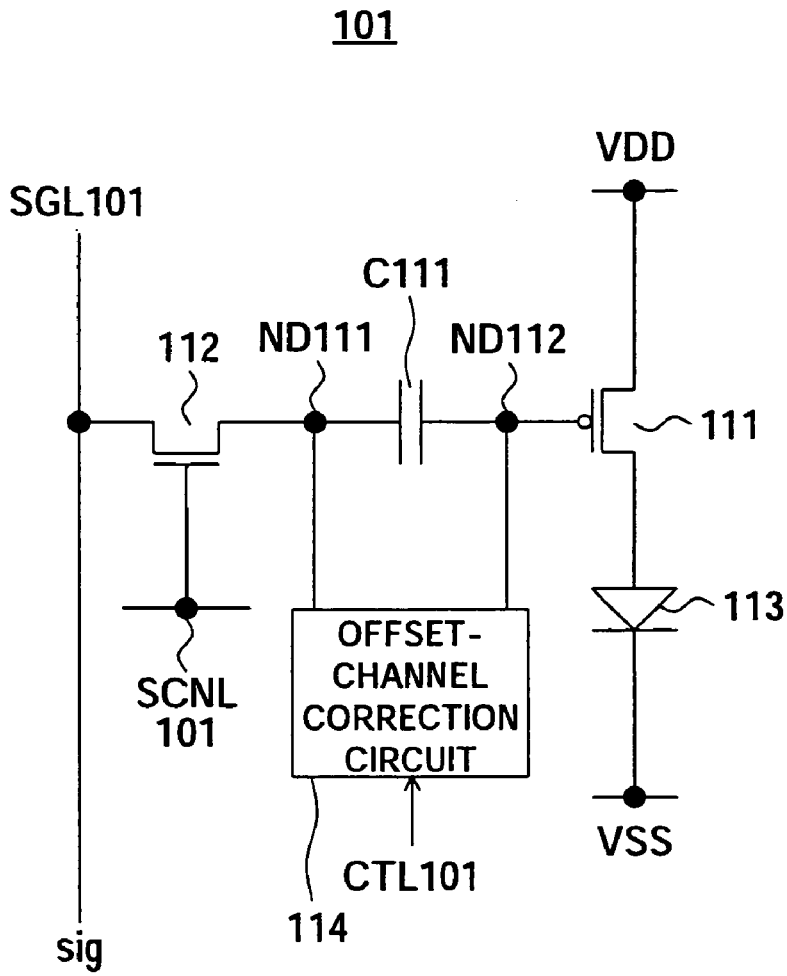
FIG. 7 is a circuit diagram illustrating a basic configuration of the pixel circuit in the organic EL display shown in FIG. 6.

FIG. 7 is a circuit diagram illustrating a basic configuration of the pixel circuit in the organic EL display shown in FIG. 6.

An organic EL display 100 has a pixel array portion 102 including pixel circuits 101 arranged in an m×n matrix, a data driver (DDRV) 103, and a scan driver (SDRV) 104.

With respect to the matrix arrangement of the pixel circuit 101, the n number of columns of signal lines SGL101-1 to SGL101-n selected and driven by the data driver (DDRV) 103 is interconnected in each pixel row, and the m number of rows of scan lines SCNL101-1 to SCNL101-m as first control lines and the m number of rows of offset-channel correction control lines CTL101-1 to CTL101-m as second control lines, which are selected and driven by the scan driver (SDRV) 104, are interconnected in each pixel row.

Next, a specific configuration of each of the pixel circuit 101 will be explained.

The pixel circuit 101, as shown in FIG. 7, has a p-channel TFT 111 as a drive transistor, an n-channel TFT 112 (write transistor) as a first switch, an organic EL light emitting element 113, a capacitor C111 as a coupling capacitance, an offset-channel correction circuit 114, and nodes ND111 and ND112.

In the pixel circuit 101 shown in FIG. 7, a source of the TFT 111 is connected to a supply line of a power source voltage VDD as a first reference potential, a drain of the same is connected to an anode of the light emitting element 113, and an cathode of the light emitting element 113 is connected to a second reference potential VSS (for example, a grand potential).

A gate (control terminal) of the TFT 111 is connected to the node ND112, and a source and a drain of the TFT 112 are respectively connected to a signal line SGL101 and the node ND111.

The capacitor C111 as the coupling capacitance is connected between the node ND111 and the node ND112. Specifically, a first electrode of the capacitor C111 is connected to the node ND111, and a second electrode of the same is connected to the node ND112.

The correction circuit 114 controls an on and off operation of a correction function by a control line CTL101 driven by the scan driver 104.

The correction circuit 114 accumulates a voltage depending on the threshold voltage of the TFT 111 as the drive transistor to both ends (a first electrode terminal and a second electrode terminal) of the capacitor C111 during a period where the correction function is controlled at an on-state, and performs a correction processing so as to channel an offset.

The pixel circuit 101 of the present embodiment and having the above configuration can be driven and controlled by having a correction period for accumulating the voltage depending on the threshold voltage of the TFT 111 of the drive transistor to the both ends of the capacitor C111, a write period for turning on the TFT 112 as the first switch by the scan line SCNL101 as the first control line and writing the data signal from the signal line SGL101 to (the node ND111 of) the pixel circuit 101, and a drive period for storing the written data signal into the pixel circuit and driving the electro-optical element, as a control period for driving the organic EL light emitting element 113 as the electro-optical element.

The pixel circuit 101 of the present embodiment is driven and controlled by the data driver 103 and the scan driver 104 and by applying a first drive control method so that the correction period may be carried out once per two or more frames while each of the write period and the drive period is carried out once per frame. Namely, the pixel circuit 101 is driven and controlled by the data driver 103 and the scan driver 104 so as to have a frame having the correction period, the write period, and the drive period, and a frame having the write period and the drive period without the correction period.

Figures 8A, 8B, 8C:
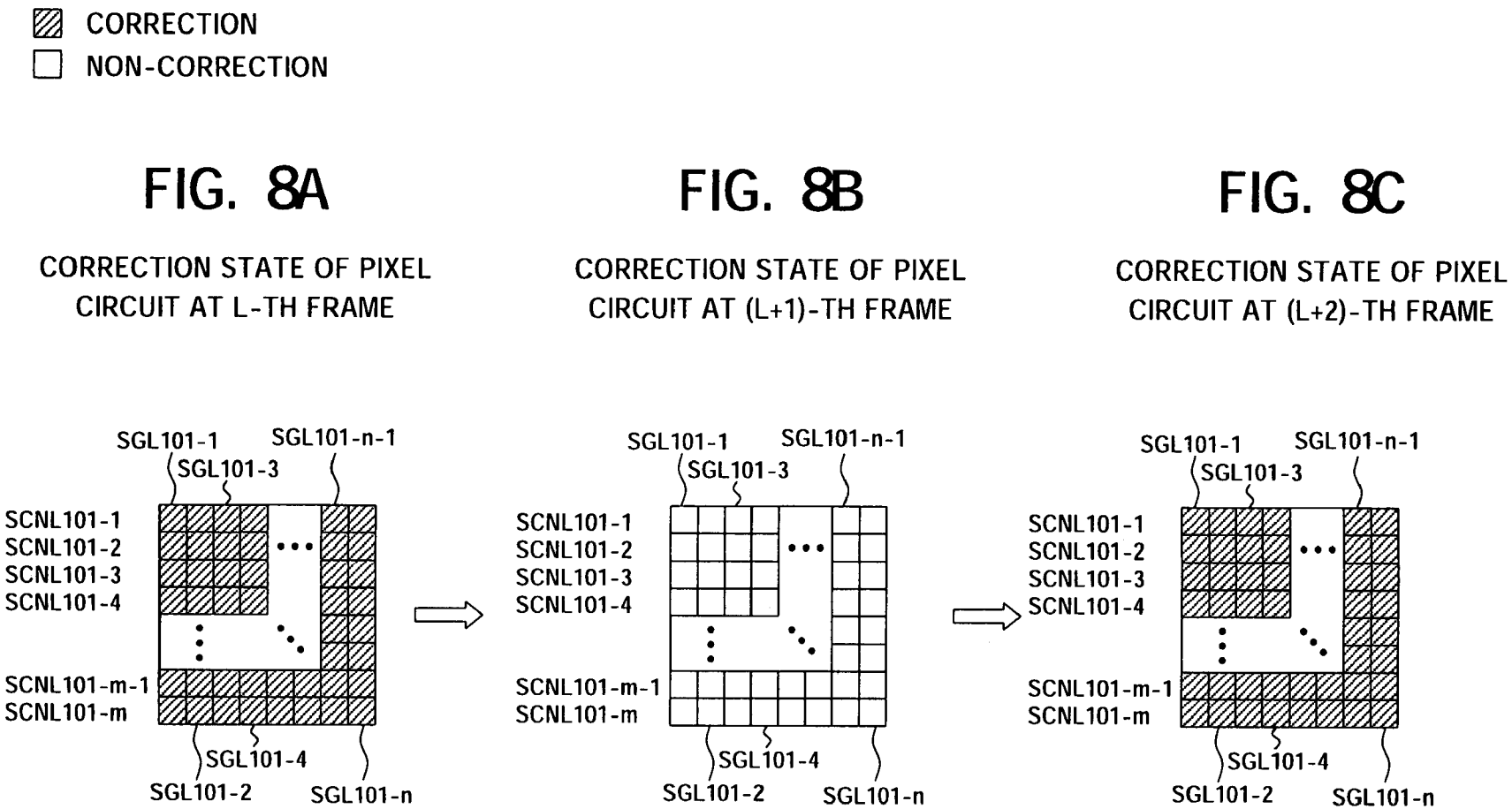
FIGS. 8A to 8C are views for illustrating a first drive control method of the entire pixel array portion of the organic EL display having the pixel circuits in which an offset-channel correction in the first embodiment is performed.

FIGS. 8A to 8C are views for illustrating the first drive control method of the entire pixel array portion of the organic EL display having the pixel circuits in which an offset channel correction in the first embodiment is performed.

Figure 9:
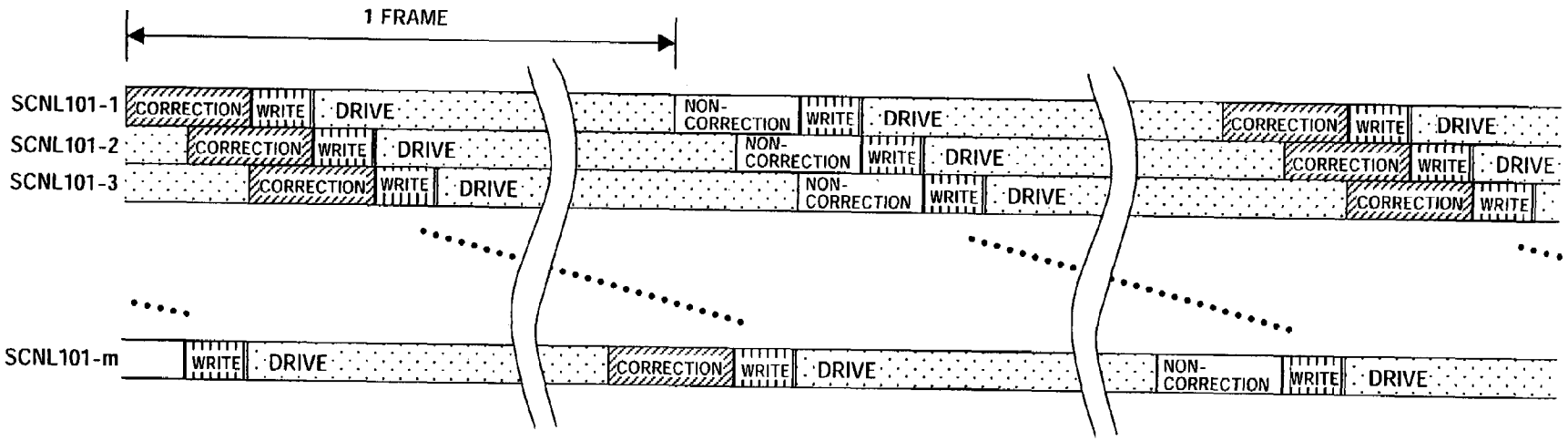
FIG. 9 is a timing chart for illustrating the first drive control method of the entire pixel array portion of the organic EL display having the pixel circuits in which the offset-channel correction in the first embodiment is performed.

FIG. 9 is a timing chart for illustrating the first drive control method of the entire pixel array portion of the organic EL display having the pixel circuits in which the offset channel correction in the first embodiment is performed.

In the first drive control method according to the first embodiment, as shown in FIGS. 8A to 8C and FIG. 9, the entire pixel circuits 101 (the entire panel) in the pixel array portion 102 repeat the frame having the correction period, the write period, and the drive period are carried out and the frame having the write period and the drive period without the correction period.

Specifically, as shown in FIG. 8A, during an L-th frame period, the entire pixel circuits 101 in the pixel array portion 102 are controlled by control lines CTL101-1 to CTL101-m so that the correction function of the correction circuit 114 may be turned on during a predetermined correction period. Therefore, an offset-channel correction is performed in the entire pixel circuits 101 in the pixel array portion 102.

Next, as shown in FIG. 8B, during an (L+1)-th frame period, the entire pixel circuits 101 of the pixel array portion 102 are controlled by control lines CTL101-1 to CTL101-m so that the correction function of the correction circuit 114 may be turned off during the predetermined correction period. Therefore, the offset-channel correction is not performed in the entire pixel circuits 101 of the pixel array portion 102.

Then, as shown in FIG. 8C, during an (L+2)-th frame period, the entire pixel circuits 101 of the pixel array portion 102 are controlled by control lines CTL101-1 to CTL101-m so that the correction function of the correction circuit 114 may be turned on during the predetermined correction period. Therefore, the offset-channel correction is performed in the entire pixel circuits 101 of the pixel array portion 102.

As subsequence steps, the on and off control of the correction function is alternately controlled in each frame.

As described above, in the first embodiment, in the case of paying attention to a single pixel, the pixel is driven so that the above correction period may be carried out only once per a plurality of the frame (two frame in the preset embodiment). Namely, the frame having the correction period and the frame not having the correction period is not carried out may exist. As a result, the following effects can be obtained.

Although the circuit consumes the power due to also perform the charge and discharge during the correction period, the correction period is set once per a plurality of the frame, so the power consumption can be reduced.

Some of the correction circuit system allows the organic EL light emitting element 113 to emit light during the correction period, which causes a deterioration of contrast. According to the present embodiment, since the correction period is set once per a plurality of the frame, an improvement of the contrast is possible.

Note that, although a configuration in which the correction period is set once per a plurality of the frame is adopted in the present embodiment, a configuration in which the correction period is set once per a plurality of the field can be adopted. In this case, the improvement of contrast is also possible.

Second Embodiment

Figure 10:
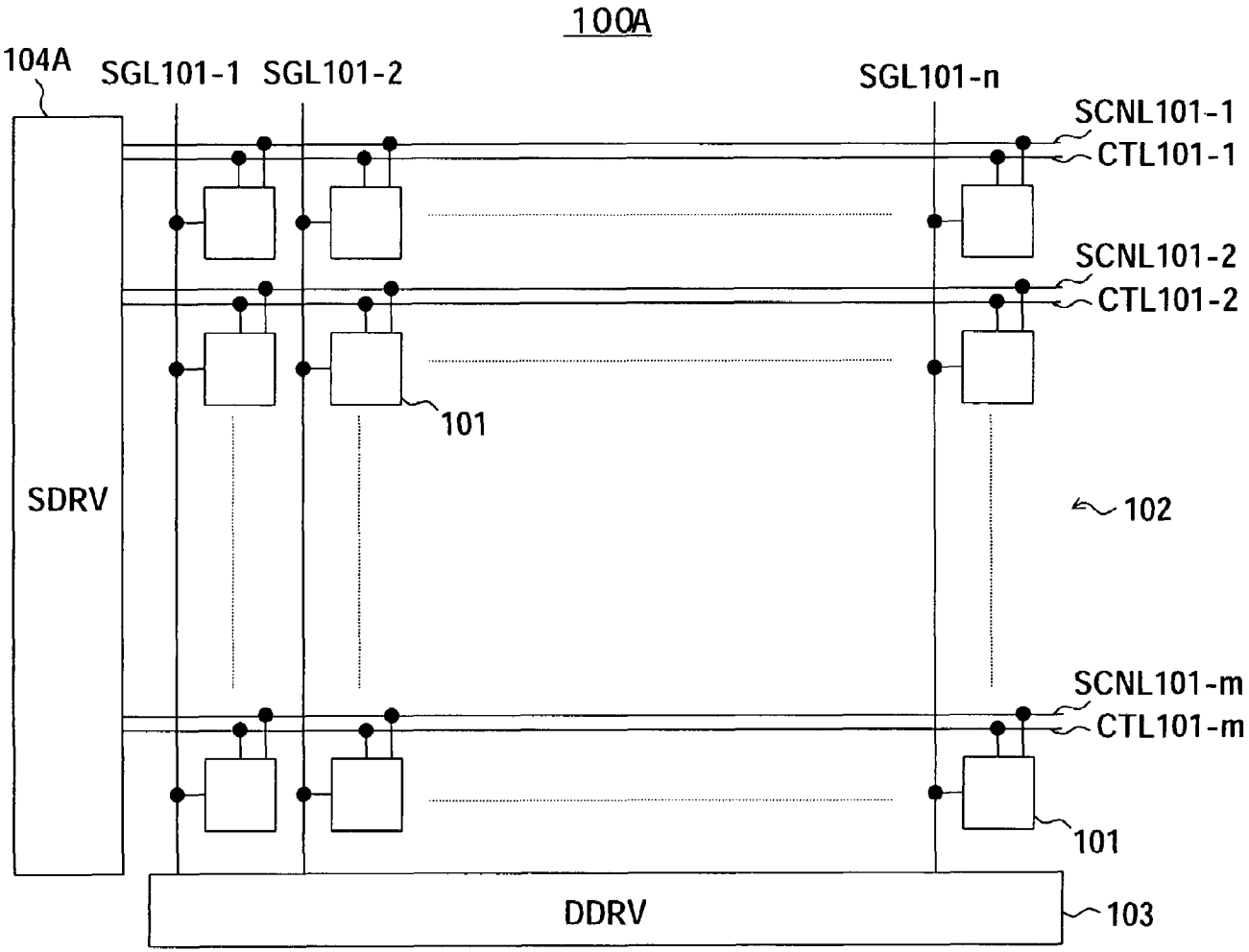
FIG. 10 is a block diagram illustrating a configuration of an active matrix organic EL display (display device) employing a pixel circuit according to a second embodiment.

FIG. 10 is a block diagram illustrating a configuration of an active matrix organic EL display (display device) employing a pixel circuit according to a second embodiment.

Figures 11A, 11B, 11C:
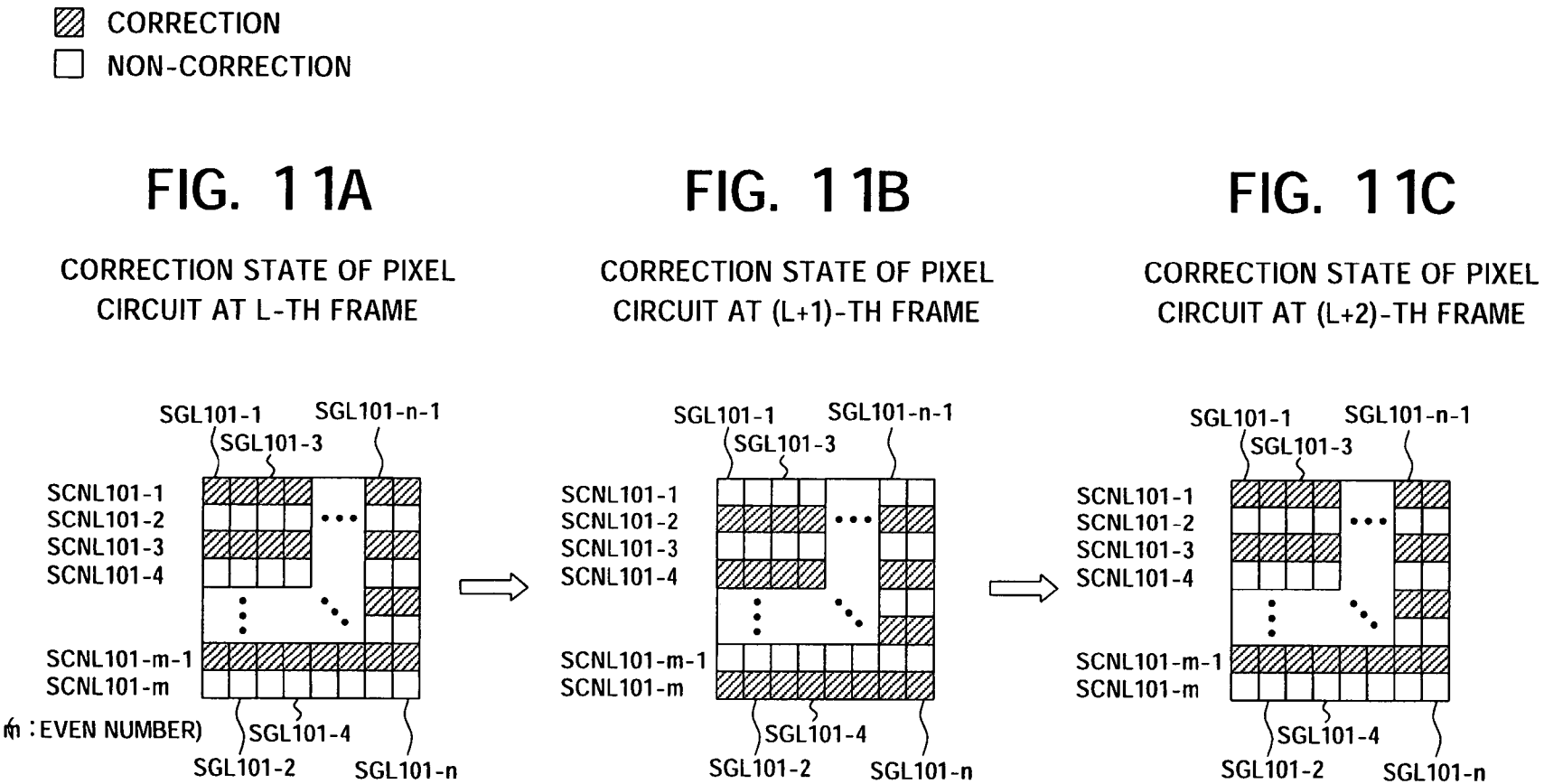
FIGS. 11A to 11C are views for illustrating a second drive control method of the entire pixel array portion of the organic EL display having the pixel circuits in which an offset-channel correction in the second embodiment is performed.

FIGS. 11A to 11C are views for illustrating a second drive control method of the entire pixel array portion of an organic EL display 100A having pixel circuits in which an offset-channel correction in the second embodiment is performed.

Figure 12:
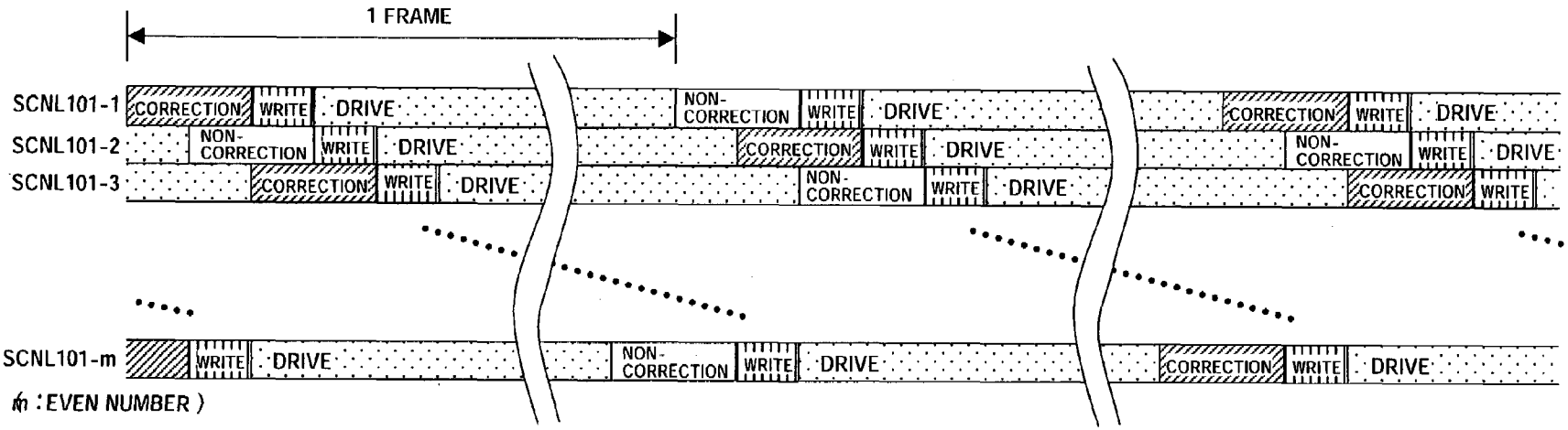
FIG. 12 is a timing chart for illustrating the second drive control method of the entire pixel array portion of the organic EL display having the pixel circuits in which the offset-channel correction in the second embodiment is performed.

FIG. 12 is a timing chart for illustrating the second drive control method of the entire pixel array portion of the organic EL display 100A having the pixel circuits in which the offset-channel correction in the second embodiment is performed.

The components of the pixel circuit 101 in the second embodiment are the same as those of the first embodiment.

A different point of the second embodiment from the above first embodiment resides in that, in the offset-channel correction, the scan driver 104A changes drive control lines CTL101-1 to CTL101-m in each frame, and does not control an existence of the correction period in the entire pixel unit of the pixel array portion 102 in each frame.

Specifically, as shown in FIGS. 11A to 11C and FIG. 12, during an L-th frame, the scan driver 104A drives odd numbered control lines CTL101-1, 101-3, . . . and scan lines SCNL101-1 to 101-m so that the pixel circuits 101 connected to the odd numbered scan lines SCNL101-1, 101-3, . . . may have the correction period, the write period, and the drive period, and also drives even numbered control lines CTL101-2, 101-4, . . . , and scan lines SCNL101-1 to 101-m during the same frame so that the pixel circuits 101 connected to the even numbered scan line SCNL101-2, 101-4, . . . may have the write period and the drive period without the correction period.

The scan driver 104A, during an (L+1)-th frame, drives the odd numbered control lines CTL101-1, 101-3, . . . , and the scan lines SCNL101-1 to 101-m so that the pixel circuits 101 connected to the odd numbered scan lines SCNL101-1, 101-3, . . . may have the write period and the drive period without the correction period, and also drives the even numbered control lines CTL101-2. 101-4, . . . , and scan lines SCNL101-1 to 101-m during the same frame so that the pixel circuits 101 connected to the even numbered control lines CTL101-2, 101-4, . . . may have the correction period, the write period, and the drive period.

The scan driver 104A, during an (L+2)-th frame, drives the odd numbered control lines CTL101-1, 101-3, . . . , and the scan line SCNL101-1 to 101-m so that the pixel circuit 101 connected to the odd numbered scan line CTL101-1, 101-3, . . . may have the correction period, the write period, and the drive period, and also drives the even numbered control line CTL101-2, 101-4, . . . , and the scan line SCNL101-1 to 101-m during the same frame so that the pixel circuit 101 connected to the even numbered control line CTL101-2, 101-4, . . . may have the write period and the drive period without the correction period.

According to the second embodiment, the following effects can be obtained in addition to the effect of the first embodiment described above.

In the first embodiment, the entire panel has the correction period once per two frames, so it has a cycle in every two frames, which may cause flicker. Otherwise, according to the second embodiment, the existence of the correction period is allocated in each scan line (each row of the matrix arrangement), so it has advantages in that the flicker can be prevented.

Third Embodiment

Figure 13:
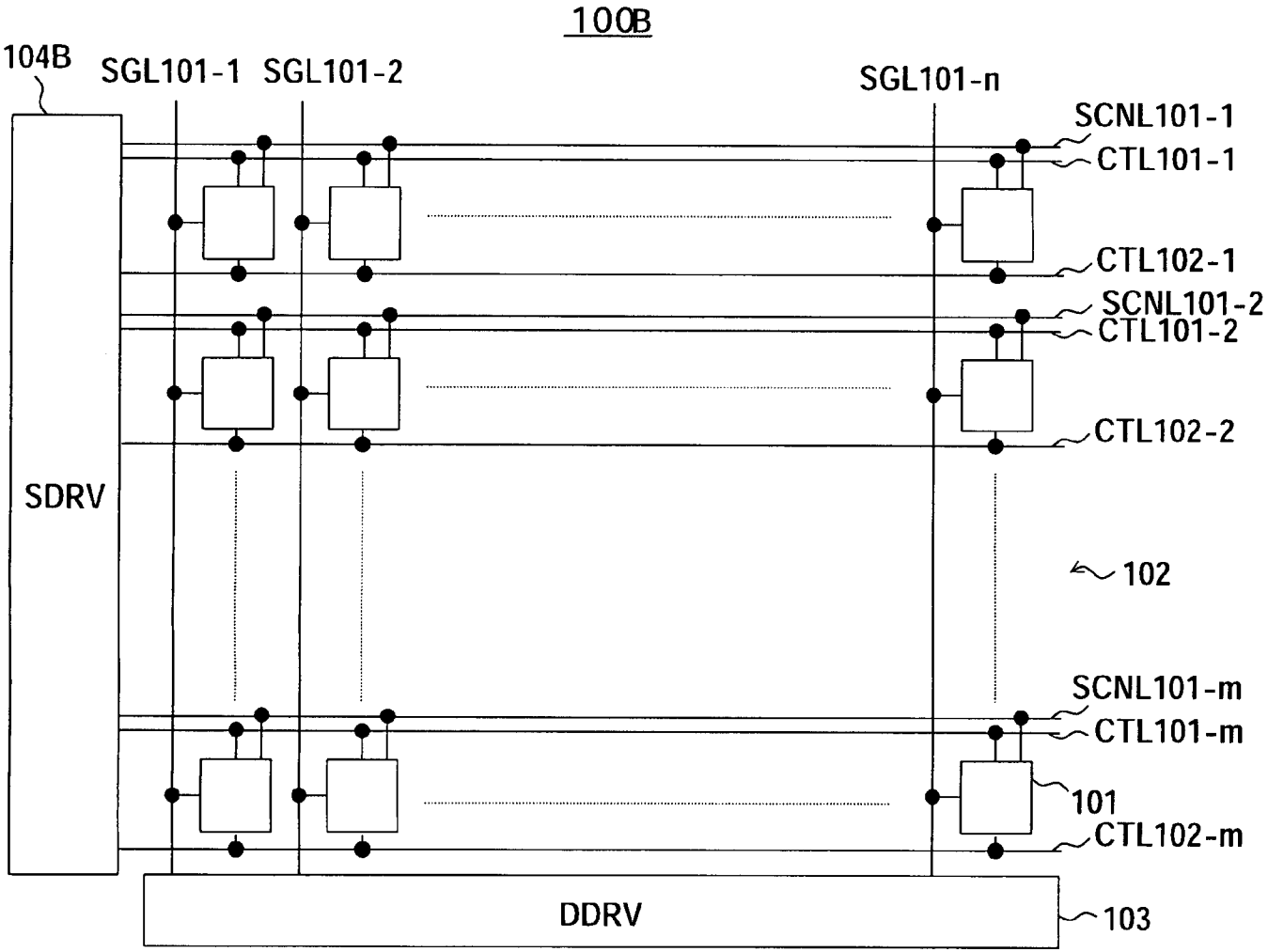
FIG. 13 is a block diagram illustrating a configuration of an active matrix organic EL display (display device) employing a pixel circuit according to a third embodiment is adopted.

FIG. 13 is a block diagram illustrating a configuration of an active matrix organic EL display (display device) employing a pixel circuit according to the third embodiment.

Figures 14A, 14B, 14C:
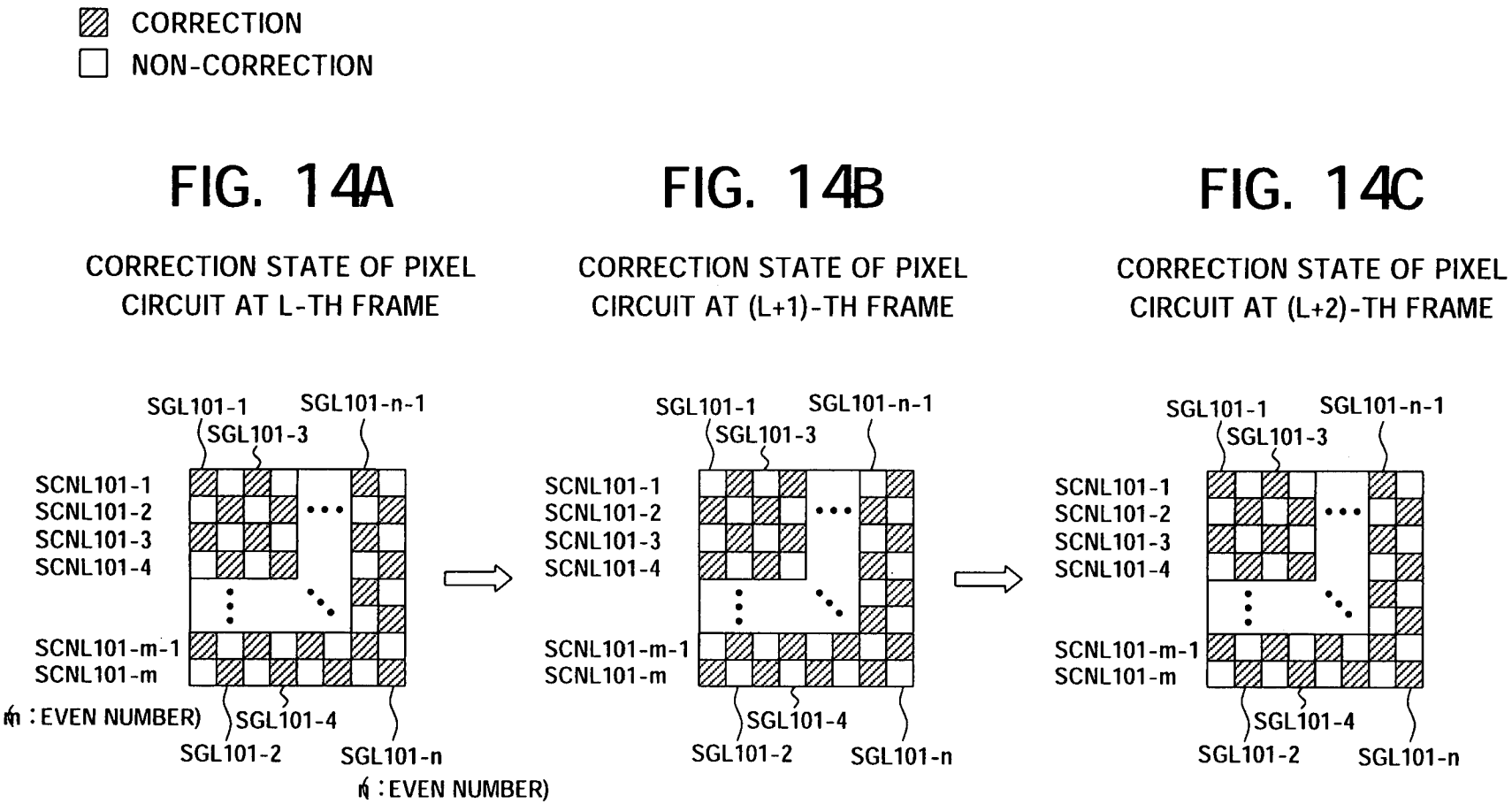
FIGS. 14A to 14C are views for illustrating a third drive control method of the entire pixel array portion of the organic EL display having the pixel circuits in which an offset-channel correction in the third embodiment is performed.

FIGS. 14A to 14C are views for illustrating a third drive control method of the entire pixel array portion 102 of the organic EL display 100B having the pixel circuits in which an offset-channel correction in the third embodiment is performed.

Figure 15:
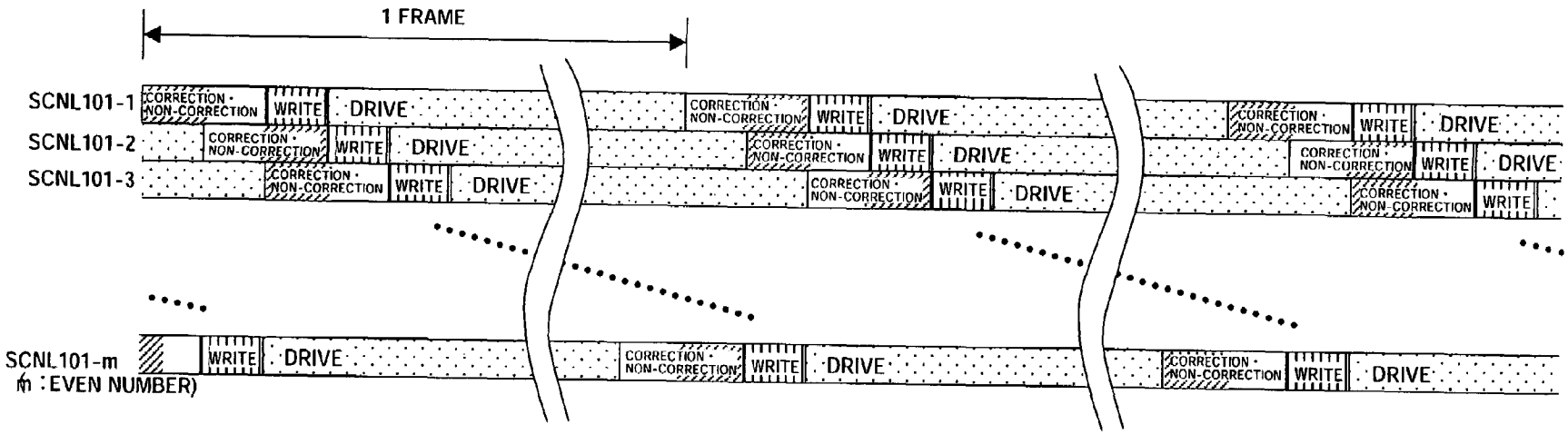
FIG. 15 is a timing chart for illustrating the third drive control method of the entire pixel array portion of the organic EL display having the pixel circuits in which the offset-channel correction in the third embodiment is performed.

FIG. 15 is a timing chart illustrating the third drive control method of the entire pixel array portion 102 of the organic EL display 100B having the pixel circuits in which the offset-channel correction in the third embodiment is performed.

The components of the pixel circuit 101 in the third embodiment are the same as those of the first and second embodiments.

A different point of the third embodiment from the above second embodiment resides in that the first correction control lines CTL101-1 to 101-m and the second correction control lines 102-1 to 102-m for controlling the correction circuit 114 are arranged in every scan line, namely, each row of the matrix arrangement, and the first correction control lines CTL101-1 to 101-m control the correction circuits 114 of the pixel circuits 101 in an odd numbered column of the matrix arrangement and the second correction control lines CTL102-1 to 102-m controls the correction circuits 114 of the pixel circuits 101 in an even numbered column of the same.

Namely, in the third embodiment, in addition to the method for controlling the existence of the correction period in an odd numbered scan line unit and an even numbered scan line unit as described in the second embodiment, a drive operation is performed so that the existence of the correction period is different between pixels adjoined in a lateral direction in the drawing.

Specifically, as shown in FIGS. 14A to 14C and FIG. 15, during an L-th frame, the scan driver 104B drives the first correction control lines CTL101-1, 101-3, . . . , and the scan lines SCNL101-1 to 101-m so that the pixel circuits 101 connected to the odd numbered scan lines SCNL101-1, 101-3, . . . , and the first correction control lines CTL101-1, 101-3, . . . may have the correction period, the write period, and the drive period, and also drives the second correction control lines CTL102-1, 102-3, . . . , and the scan lines SCNL101-1 to 101-m during the same frame so that the pixel circuits 101 connected to the odd numbered scan lines SCNL101-1, 101-3, . . . , and the second correction control lines CTL102-1, 102-3, . . . may have the write period and the drive period without the correction period.

In the same way, during the L-th frame, the scan driver 104B drives the first correction control lines CTL101-2, 101-4, . . . , and the scan lines SCNL101-1 to 101-m so that the pixel circuits 101 connected to the even numbered scan lines SCNL101-2, 101-4, . . . , and the first correction control line CTL101-2, 101-4, . . . may have the write period and the drive period without the correction period, and also drives the second correction control lines CTL102-2, 102-4, . . . , and the scan lines SCNL101-1 to 101-m during the same frame so that the pixel circuits 101 connected to the even numbered scan lines SCNL101-2, 101-4, . . . , and the second correction control lines CTL102-2, 102-4, . . . may have the correction period, the write period, and the drive period.

During the following (L+1)-th frame, the scan driver 104B drives the first correction control lines CTL101-1, 101-3, . . . , and the scan lines SCNL101-1 to 101-m so that the pixel circuits 101 connected to the odd numbered scan lines SCNL101-1, 101-3, . . . , and the first correction control lines CTL101-1, 101-3, . . . may have the correction period, the write period, and the drive period, and also drives the second correction control lines CTL102-1, 102-3, . . . , and the scan lines SCNL101-1 to 101-m during the same frame so that the pixel circuits 101 connected to the odd numbered scan lines SCNL101-1, 101-3, . . . , and the second correction control lines CTL102-1, 102-3, . . . may have the write period and the drive period without the correction period, and also drives the second correction control lines CTL102-1, 102-3, . . . , and the scan lines SCNL101-1 to 101-m during the same frame so that the pixel circuits 101 connected to the odd numbered scan lines SCNL101-1, 101-3, . . . , and the first correction control lines CTL101-1, 101-3, . . . may have the correction period, the write period, and the drive period.

In the same way, during the (L+1)-th frame, the scan driver 104B drives the first correction control lines CTL101-2, 101-4, . . . , and the scan lines SCNL101-1 to 101-m so that the pixel circuits 101 connected to the even numbered scan lines SCNL101-2, 101-4, . . . , and the first correction control lines CTL101-2, 101-4, . . . may have the correction period, the write period, and the drive period, and also drives the second correction control lines CTL102-2, 102-4, . . . , and the scan lines SCNL101-1 to 101-m during the same frame so that the pixel circuits 101 connected to the even numbered scan lines SCNL101-2, 101-4, . . . , and the second correction control lines CTL102-2, 102-4, . . . may have the write period and the drive period without the correction period.

During the following (L+2)-th frame, the scan driver 104B drives the first correction control lines CTL101-1, 101-3, . . . , and the scan lines SCNL101-1 to 101-m so that the pixel circuits 101 connected to the odd numbered scan lines SCNL101-1, 101-3, . . . , and the first correction control lines CTL101-1, 101-3, . . . , may have the correction period, the write period, and the drive period, and also drives the second correction control lines CTL102-1, 102-3, . . . , and the scan lines SCNL101-1 to 101-m during the same frame so that the pixel circuits 101 connected to each odd numbered scan line SCNL101-1, 101-3, . . . , and the second correction control lines CTL102-1, 102-3, . . . may have the write period and the drive period without the correction period.

In the same way, during the (L+2)-th frame, the scan driver 104B drives the first correction control lines CTL101-2, 101-4, . . . , and the scan lines SCNL101-1 to 101-m so that the pixel circuits 101 connected to the even numbered scan lines SCNL101-2, 101-4, . . . , and the first correction control lines CTL101-2, 101-4, . . . may have the write period and the drive period without the correction period, and also drives the second correction control lines CTL102-2, 102-4, . . . , and the scan lines SCNL101-1 to 101-m during the same frame so that the pixel circuits 101 connected to the even numbered scan lines SCNL101-2, 101-4, . . . , and the second correction control lines CTL102-2, 102-4, . . . may have the correction period, the write period, and the drive period.

According to the third embodiment, the following effects can be obtained in addition to the effect of the first and second embodiments described above.

Namely, according to the third embodiment, the flicker can be lowered further than the second embodiment.

Fourth Embodiment

Figure 16:
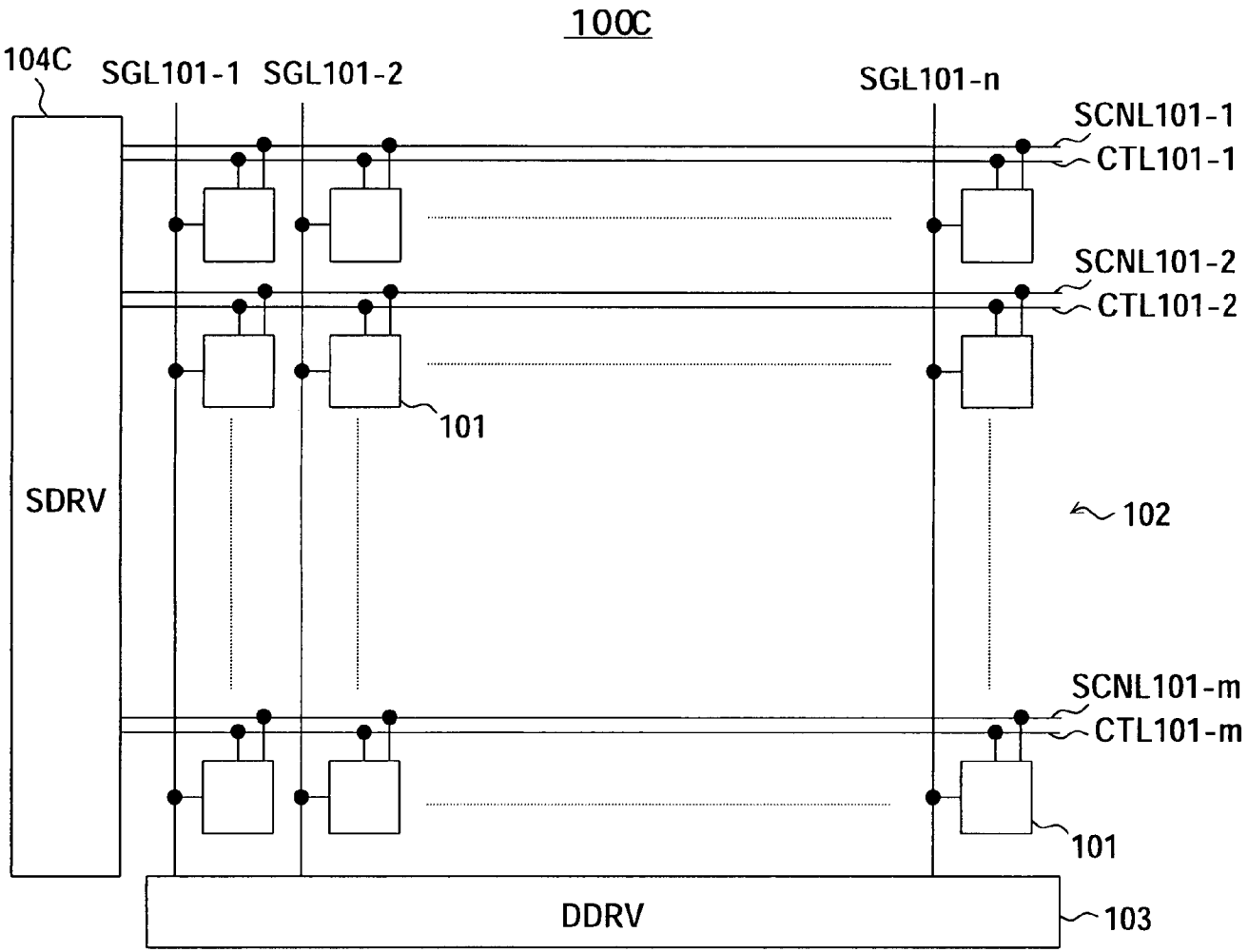
FIG. 16 is a block diagram illustrating a configuration of an active matrix organic EL display (display device) employing a pixel circuit according to a fourth embodiment.

FIG. 16 is a block diagram illustrating a configuration of an active matrix organic EL display (display device) employing a pixel circuit according to the fourth embodiment.

FIGS. 17A to 17D are views for illustrating a fourth drive control method of the entire pixel array portion 102 of the organic EL display 100C having the pixel circuits in which an offset-channel correction in the fourth embodiment is performed.

Figure 18:
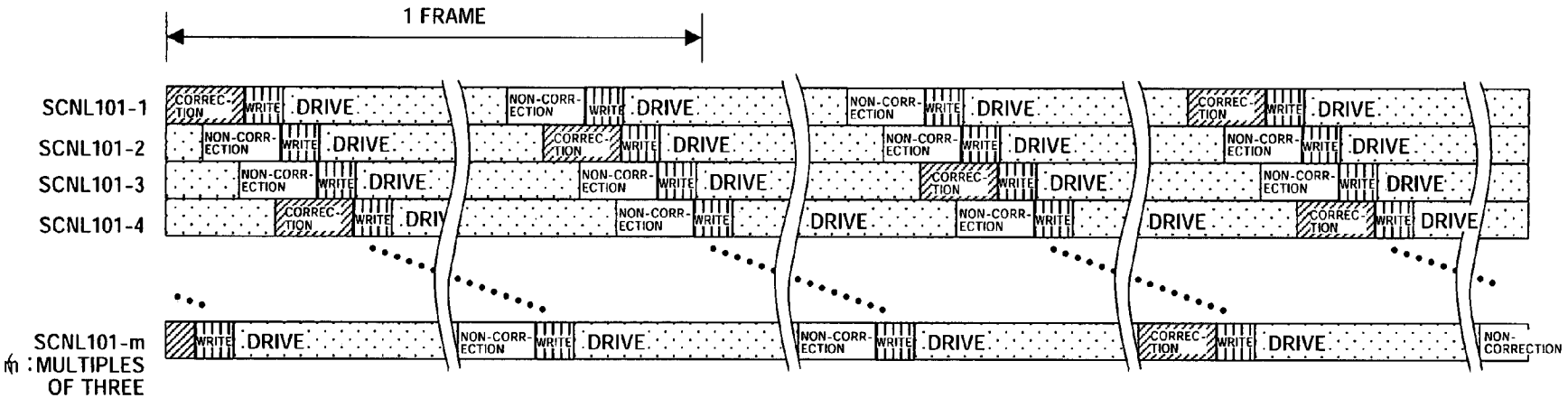
FIG. 18 is a timing chart for illustrating the fourth drive control method of the entire pixel array portion of the organic EL display having the pixel circuits in which the offset-channel correction in the fourth embodiment is performed.

FIG. 18 is a timing chart illustrating the fourth drive control method of the entire pixel array portion 102 of the organic EL display 100C having the pixel circuits in which the offset-channel correction in the fourth embodiment is performed.

The components of the pixel circuit 101 in the fourth embodiment are the same as those of the first, second, and third embodiments.

A different point of the fourth embodiment from the above second embodiment resides in that the correction is controlled successively in a plurality of row units, for example, three or more, instead of controlling the existence of the correction period alternatively in each frame in each odd numbered scan line and each even numbered scan line, namely, in each of the odd row and the even row in the matrix arrangement.

In the fourth embodiment, as shown in FIGS. 17A to 17D and FIG. 18, the drive method in which the correction period is set once per three frames may be applied. Also, a drive method in which the correction period is set once per four frames may be applied.

The basic operation is similar to the second embodiment and detail explanation thereof is omitted.

Note that, each of the first to fourth drive control methods described above may be selected in consideration of, for example, an influence of the flicker and a circuit size.

Figure 3:
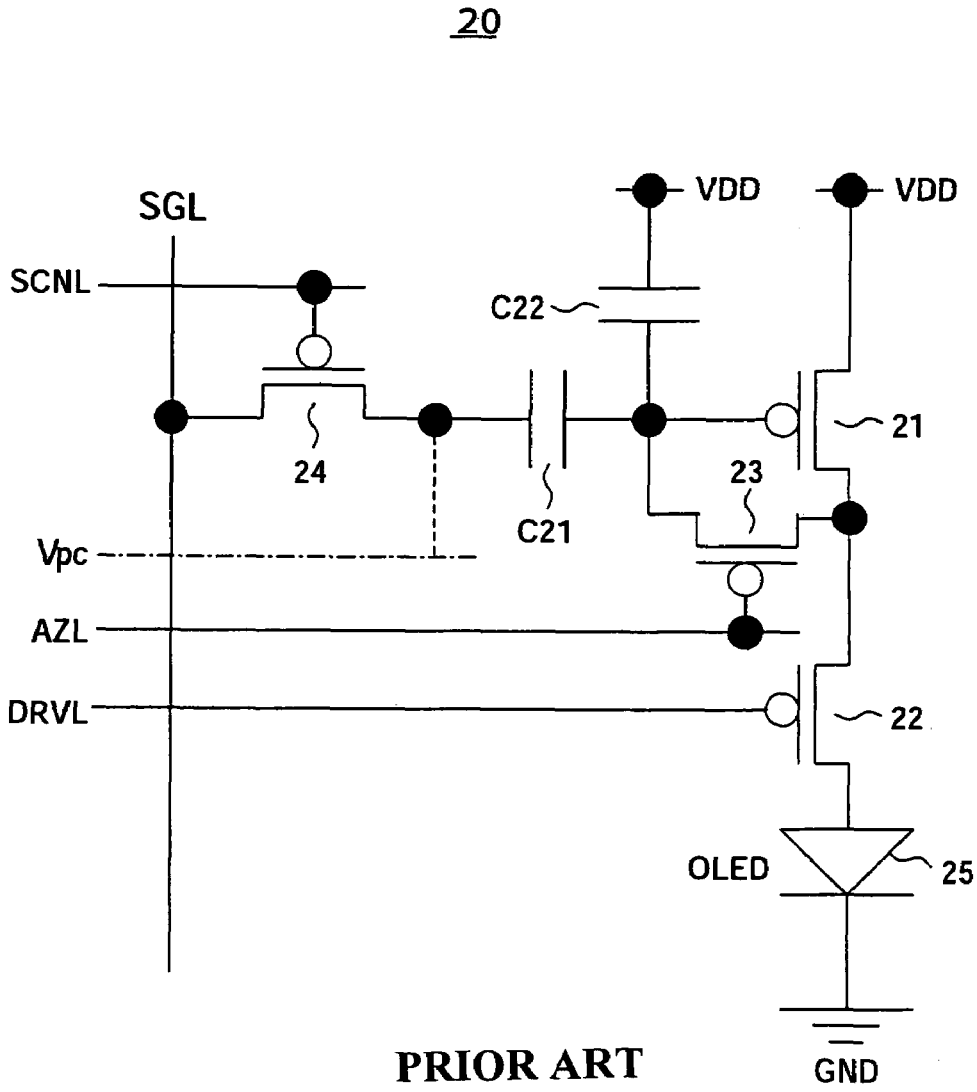
FIG. 3 is a circuit diagram illustrating an example of a second configuration of the pixel circuit in the related art.
Figures 4A, 4B, 4C, 4D, 4E:
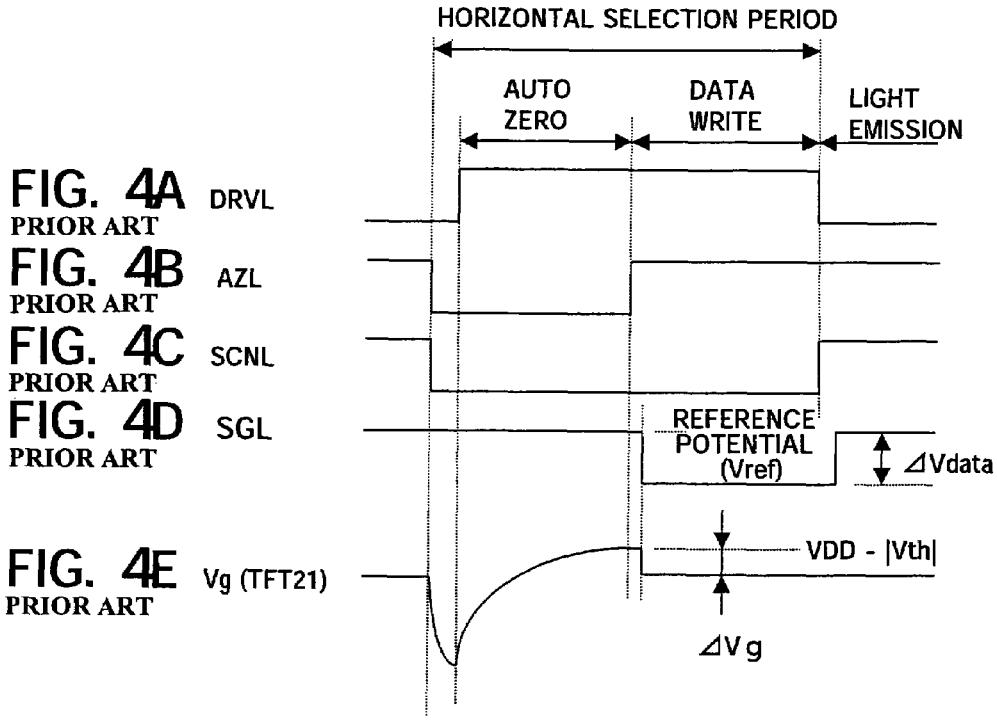
FIG. 4A PRIOR ART
FIG. 4B PRIOR ART
FIG. 4C PRIOR ART
FIG. 4D PRIOR ART
FIG. 4E PRIOR ART
FIGS. 4A to 4E are timing charts for illustrating a drive method of the circuit shown in FIG. 3.
Figure 5:
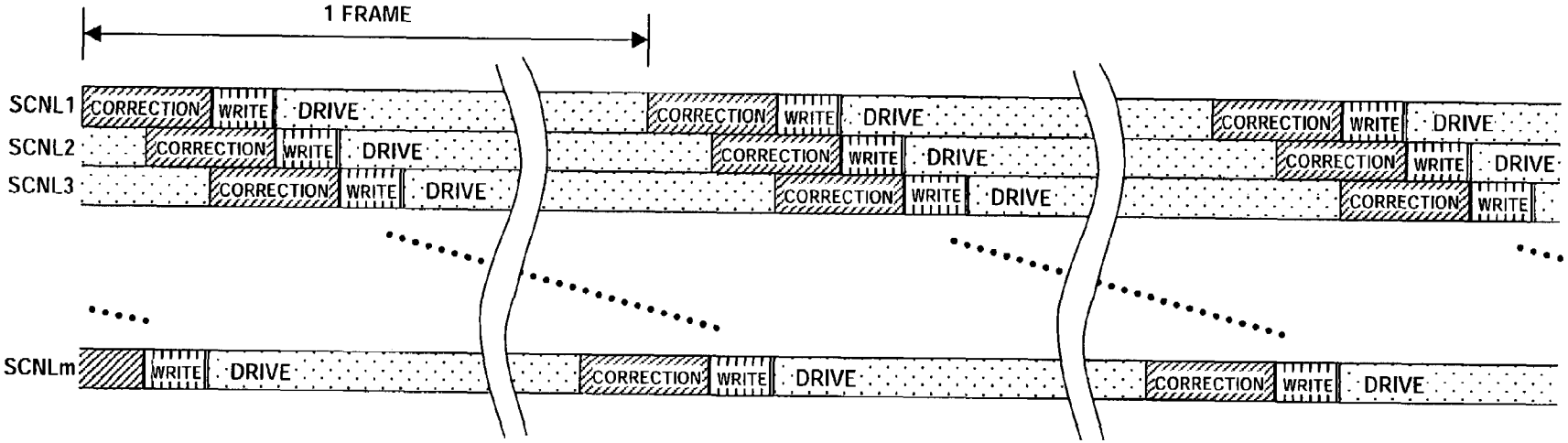
FIG. 5 is a view illustrating a timing example of an offset channel.

Although the pixel circuit in the above embodiments is described by applying the basic circuit as shown in FIG. 7 for example, specific pixel circuits described in the followings and including the circuit shown in FIG. 3 can be applied, and the first to fourth drive control methods described above can be applied to the organic EL display having each of the pixel circuits.

Figure 19:
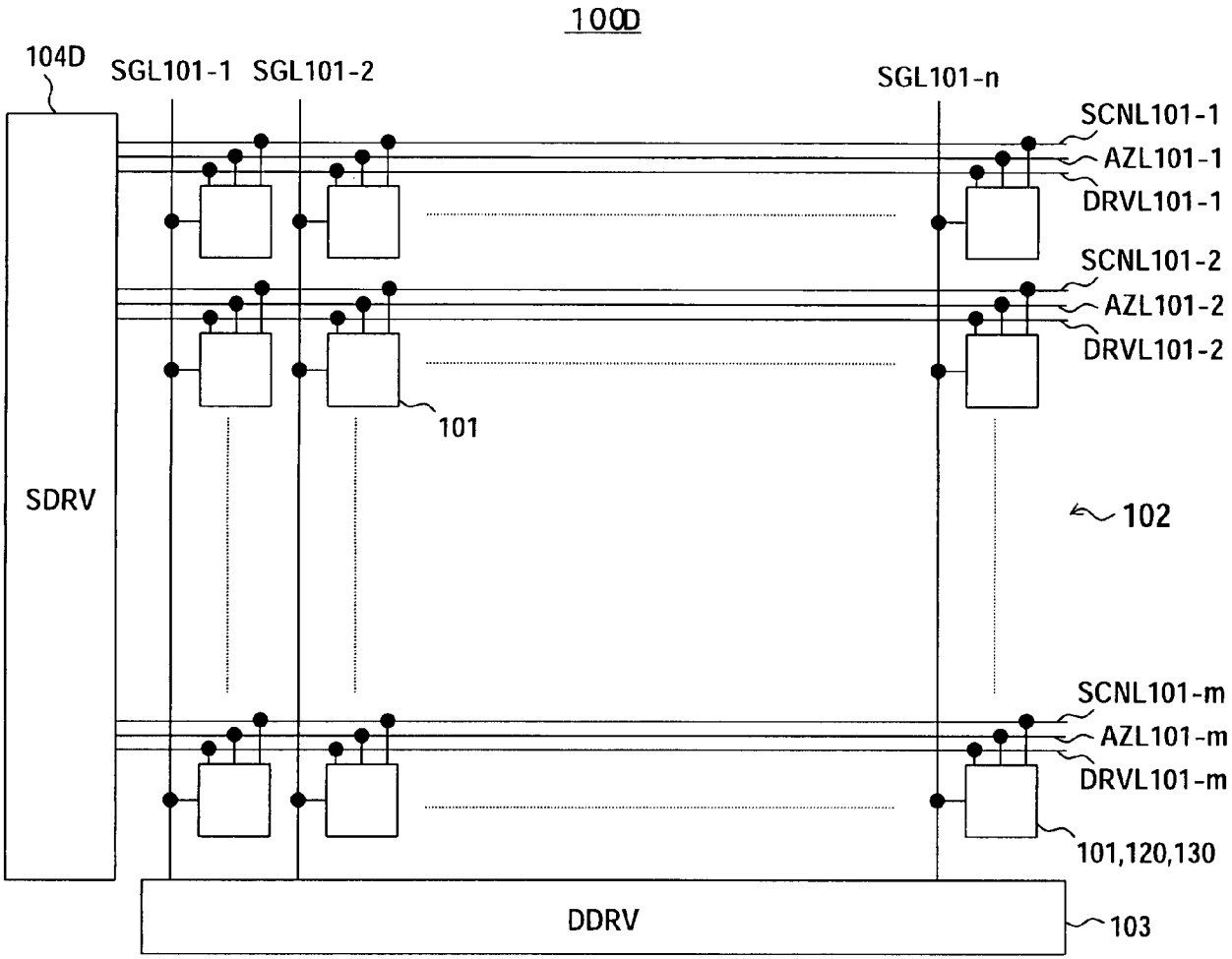
FIG. 19 is a block diagram illustrating a specific example of the organic EL display employing the first, the second, and the fourth drive control methods of the present embodiments.
Figure 20:
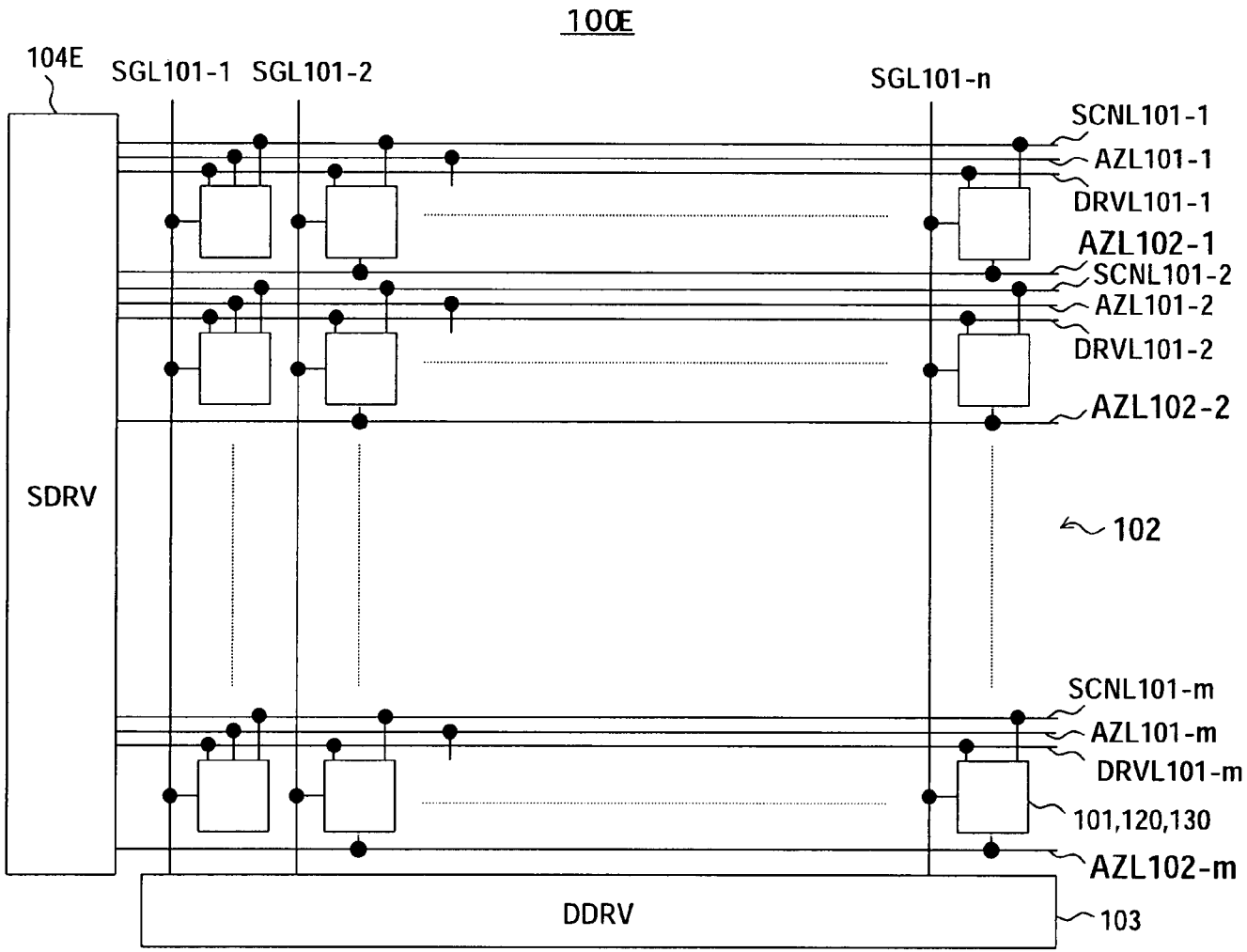
FIG. 20 is a block diagram illustrating a specific example of the organic EL display employing the third drive control methods of the present embodiment.

Note that, the first, second, and fourth drive control methods can be applied to the organic EL display 100D shown in FIG. 19, and the third drive control method can be applied to the organic EL display 100E shown in FIG. 20.

A point of difference in the configuration of FIG. 19 from configurations of FIG. 6, FIG. 10, and FIG. 16 resides in that instead of the control lines CTL101-1 to CTL101-m, auto-zero lines AZL101-1 to AZL101-m, are arranged and drive lines DRVL101-1 to DRVL101-m are arranged.

A point of difference in the configuration of FIG. 20 from configuration of FIG. 13 resides in that instead of the first correction control lines CTL101-1 to CTL101-m and the second correction control lines CTL102-1 to CTL102-m, auto-zero lines AZL101-1 to AZL101-m and AZL102-1 to AZL102-m, are arranged and drive lines DRVL101-1 to 101-m are arranged.

A specific control operation is performed in the same way as those of the first to the fourth embodiments.

Below, examples of the pixel circuit, where the organic EL displays 100D and 100E in FIG. 19 and FIG. 20 can be applied and a configuration for correcting the variation of property of each drive transistor is included, will be described.

Figure 21:
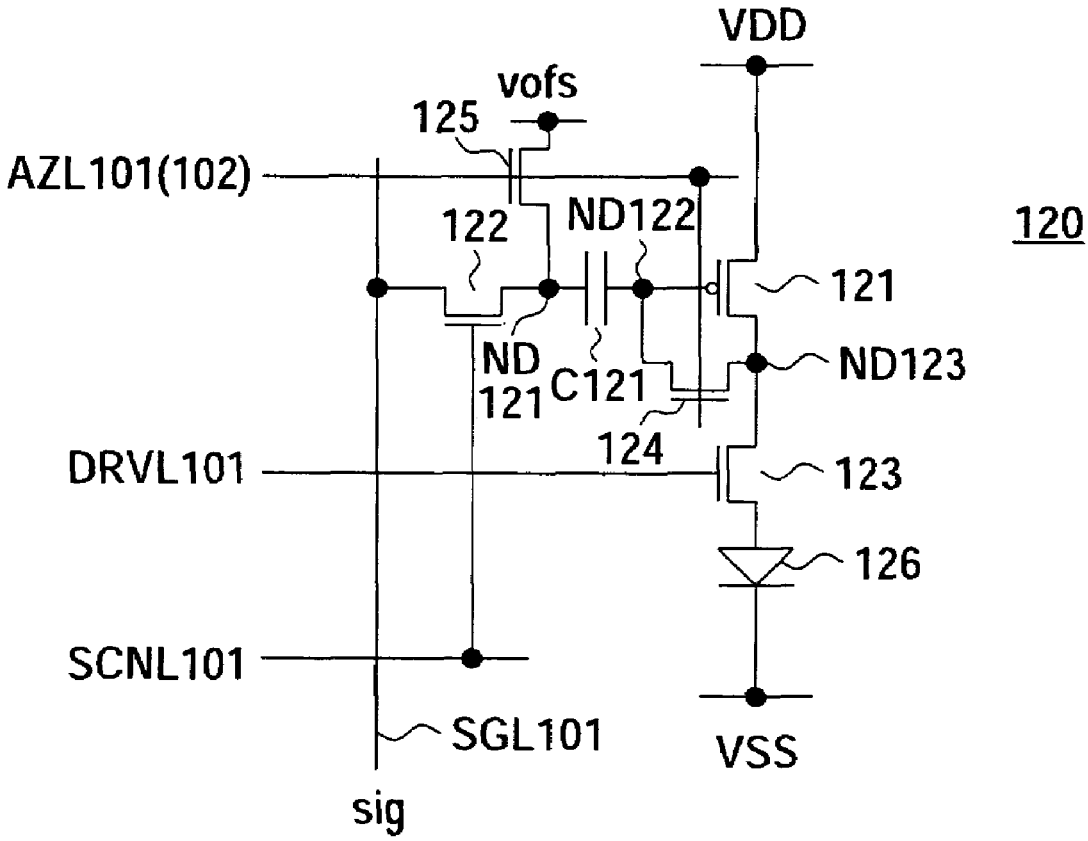
FIG. 21 is a circuit diagram illustrating a first example of a specific pixel circuit capable of being applied to the organic EL display shown in FIG. 19 and FIG. 20.

FIG. 21 is a circuit diagram illustrating a first example of a specific pixel circuit capable of being applied to the organic EL displays shown in FIG. 19 and FIG. 20.

Figures 22, 22A, 22B, 22C, 22D:
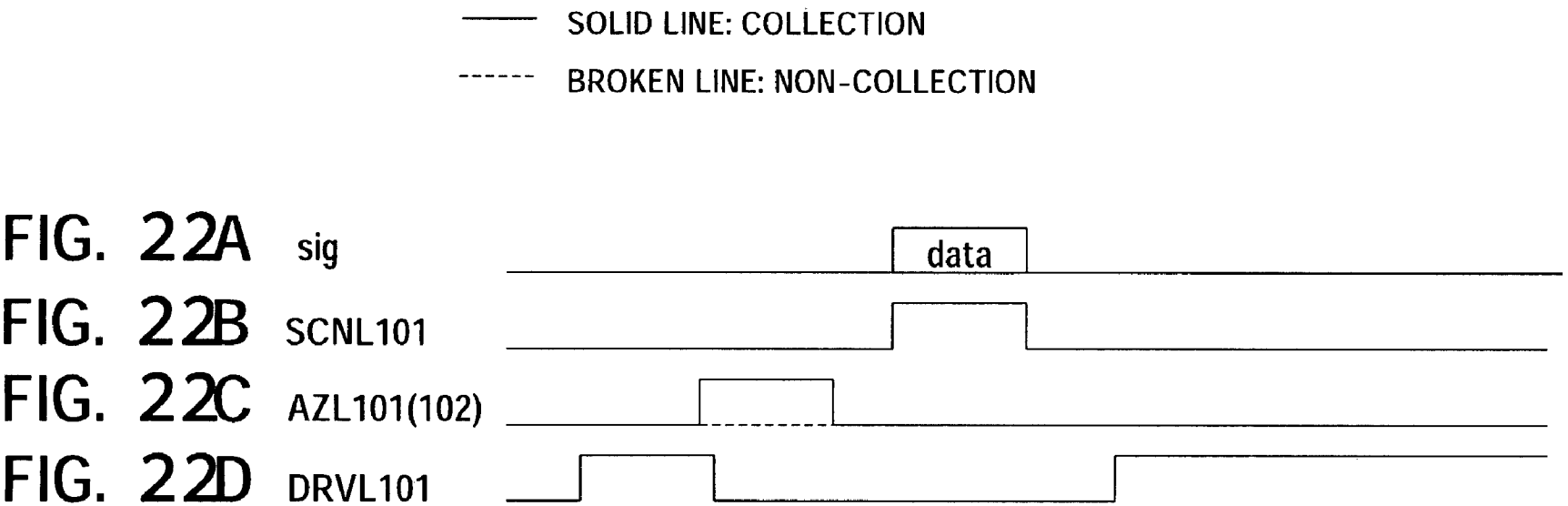
FIGS. 22A to 22D are timing charts for a basic operation, including a correction and a non-correction, of the pixel circuit shown in FIG. 21.

FIGS. 22A to 22D are timing charts for a basic operation, including a correction and a non-correction, of the pixel circuit shown in FIG. 21. In FIG. 22C, a solid line indicates a timing where the correction is performed and a broken line indicates a timing where the correction is not performed.

The pixel circuit 120 shown in FIG. 21 has a p-channel TFT 121 as the drive transistor, an n-channel TFT 122 as a first switch, an n-channel TFT 123 as a second switch, an n-channel TFT 124 as a third switch, an n-channel TFT 125 as a fourth switch, a capacitor C121, an organic EL light emitting element 126 of a light emitting element, and nodes ND121, ND122, and ND123.

In FIG. 21, "SGL101" indicates a signal line, "SCNL101" indicates a scan line, "AZL101" indicates an auto-zero line, and "DRVL101" indicates a drive line respectively.

A source of the TFT 121 is connected to a supply line of a power source voltage VDD as a first reference potential, a drain of the same is connected to the node ND123, and a gate of the same is connected to the node ND122. A source and a drain of the TFT 124 are respectively connected to the node ND122 and the node ND123.

A source and a drain of the TFT 122 are respectively connected to the node ND123 and an anode of the light emitting element 126, and a cathode of the light emitting element 126 is connected to a second reference potential VSS (for example, a grand potential).

A source and a drain of the TFT 122 respectively are connected to the signal line SGL101 and the node ND121. The capacitor C121 is connected between the node ND121 and the node ND122. A source and a drain of the TFT 125 respectively are connected to a constant potential, for example, a precharged potential vofs, and the node ND121.

A gate of the TFT 122 is connected to the scan line SCNL101, a gate of the TFT 123 is connected to the drive line DRVL101, and gates of the TFT 124 and the TFT 125 are connected to the auto-zero line AZL101.

An operation of the pixel circuit 120 will be explained with reference to the timing chart shown in FIGS. 22A to 22D.

When a drive control including a correction processing is performed, the drive line DRVL101 and the auto-zero line AZL101 are set at a high level to make the TFT 123, the TFT 124, and the TFT 125 conductive states. In this case, the TFT 121 with a diode connected is connected to the light emitting element (OLED) 126, so a constant-current Iref flows into the TFT 121.

The constant reference voltage vofs supplied from a precharged potential line VPCL is applied via the TFT 125 to the node ND121 of an end of the coupling capacitor C121.

The same voltage as a potential between the gate and the source of the TFT 121 as the drive transistor when the current Iref flows, is generated at the both ends of the coupling capacitor C121. By defining a gate side of the TFT 121 of the drive transistor as a plus direction, the potential Vref is expressed by the following formula.

$$Iref=\beta(Vref-Vth)^2 \quad (5)$$

Here, "β" indicates a proportional coefficient of the drive transistor (∝ a mobility of the drive transistor), and "Vth" indicates a threshold voltage of the drive transistor.

Namely, the potential Vref between the gate and the source-of the TFT 121 as the drive transistor is expressed by the following formula. In the present embodiment, "Iref=0" stands.

$$Vref=Vth+(Iref/\beta)^{1/2} \quad (6)$$

Then, the drive line DRVL101 is set at a low level to make the TFT 123 a non-conductive state. At this time, the scan line SCNL101 is set at the high level to make the TFT 122 the conductive state, and the reference potential Vref is applied to the signal line SGL101. Since the current flowing into the TFT 121 is cut off, the gate potential Vg of the TFT 121 rises, the TFT 121 becomes the non-conductive state off when the potential rises up to "Vcc−|Vth|", then the potential is stabilized. Namely, the auto-zero operation is performed.

The auto-zero line AZL101 is set at the low level to make the TFT 124 the non-conductive state, as a result, a data voltage Vdata is written via the signal line SGL101 into another end side (note ND122 side) of the coupling capacitor C121. Thus, the potential between the gate and the source as the drive transistor at this time is expressed by the following formula.

$$Vgs = Vdata + Vref - Vsource \quad (7)$$

$$= Vdata + Vth + (Iref/\beta)^{1/2} - Vsource$$

Therefore, the current Ids flowing into the drive transistor is expressed by the following.

$$Ids=\beta(Vdata+(Iref/\beta)^{1/2}-Vsource)^2 \quad (8)$$

Namely, the current Ids flowing into the drive transistor does not depend on the threshold voltage Vth, namely, a threshold-voltage correction is performed.

Note that, in order that the light emitting element 126 starts to emit light, an operation, in which the scan line SCNL101 is set at the low level to make the TFT 122 the non-conductive state, and the drive line DRVL101 is set at the high level to make the TFT 123 the conductive state, is performed after the data voltage is written.

Otherwise, when a drive control in which the correction processing is not performed is performed, as shown in FIGS. 22C and 22D, the drive line DRVL101 is set at the high level to make the TFT 123 the conductive state, and the auto-zero line AZL101 is set at the low level to make the TFT 124 and the TFT 125 the non-conductive states. At this time, the TFT 121 with a diode connected is connected to the light emitting element (OLED) 126, so the constant current Iref flows into the TFT 121.

Also, at this time, the node ND121 is not precharged and the offset-channel correction (auto-zero operation) is not performed, and a control of emitting light of the light emitting element 126 is performed during the usual write period and drive period.

According to the organic EL displays 100D and 100E employing the pixel circuit 120, the same effect as those of the first to fourth embodiments described above can be obtained.

When a drive control not including the correction processing is performed, a timing where the TFT 122 is turned on can be advanced by the scan line SCNL101, therefore, a drive control operation can be performed at high speed.

Note that, the pixel circuit 120 shown in FIG. 21 is an example and the present invention is not limited thereto. For example, as described above, the TFT 122 to the TFT 125 are mere switches, so it is obvious that a part of the above TFTs or the entire TFT can be formed by a p-channel TFT or other switch elements.

Figure 23:
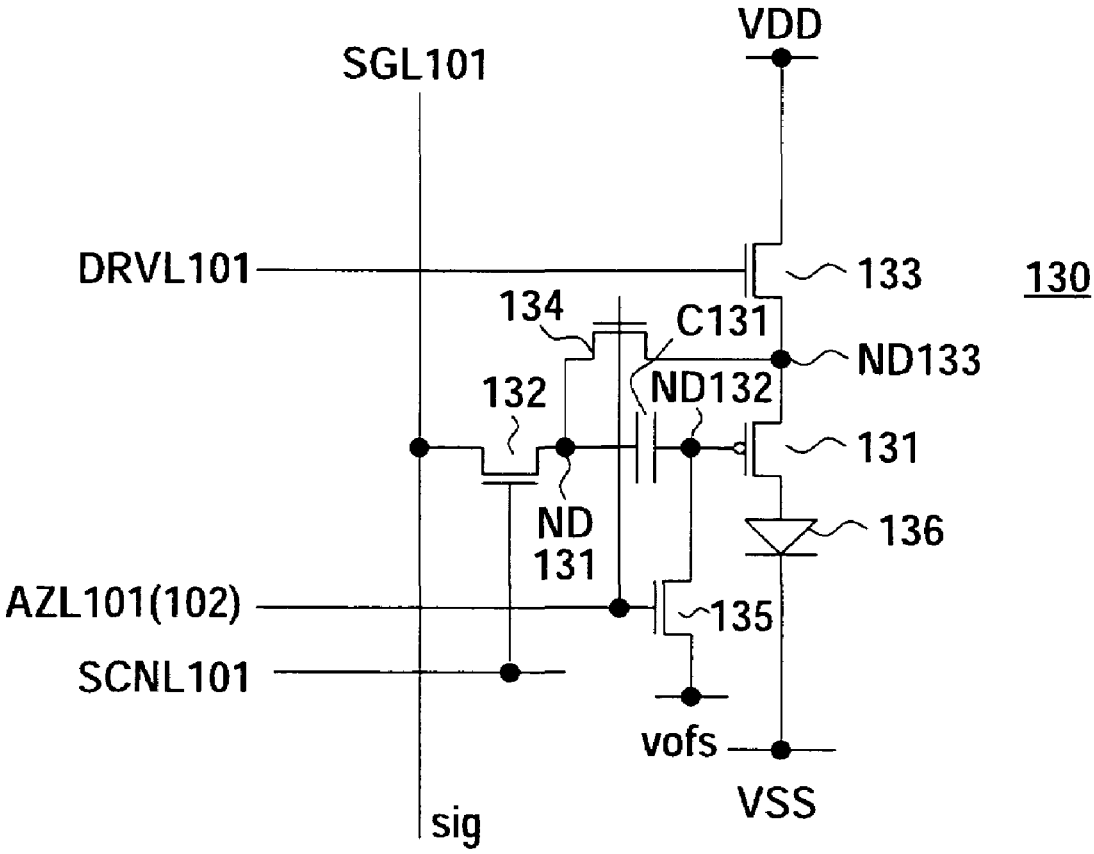
FIG. 23 is a circuit diagram illustrating a second example of a specific pixel circuit capable of being applied to the organic EL displays shown in FIG. 19 and FIG. 20.

FIG. 23 is a circuit diagram illustrating a second example of a specific pixel circuit capable of being applied to the organic EL displays shown in FIG. 19 and FIG. 20.

Figure 24:
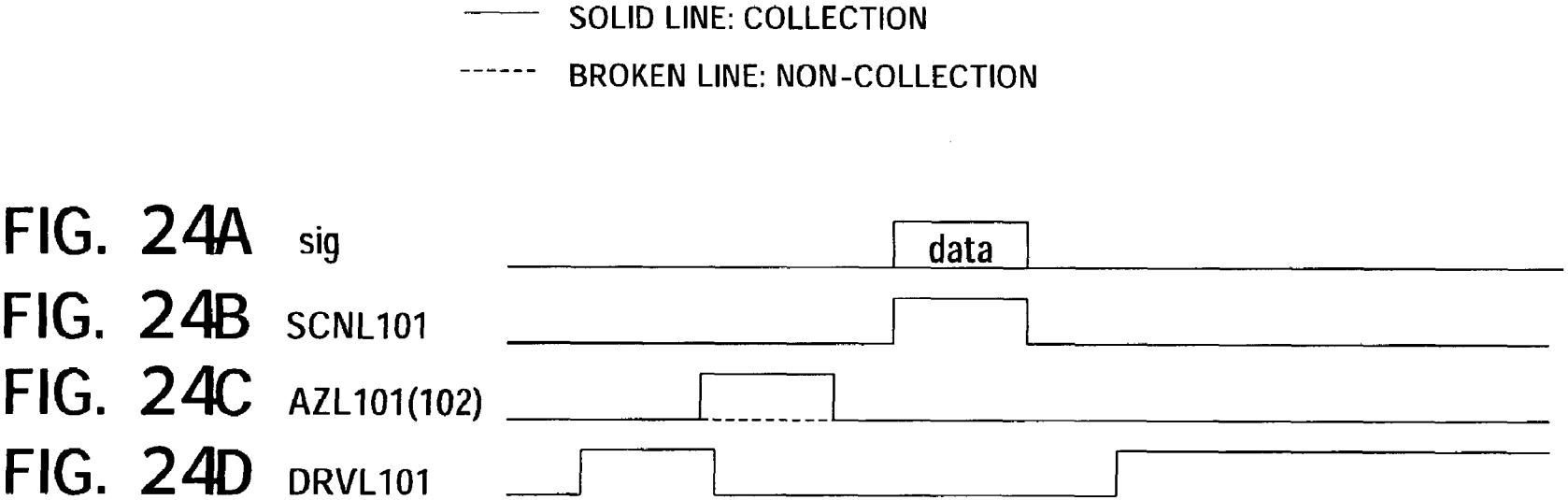
FIGS. 24A to 24D are timing charts for a basic operation, including a correction and a non-correction, of the pixel circuit shown in FIG. 23.

FIGS. 24A to 24D are timing charts for a basic operation, including a correction and a non-correction, of the pixel circuit shown in FIG. 23. In FIG. 24C, a solid line indicates a timing when the correction is performed and a broken line indicates a timing when the correction is not performed.

The pixel circuit 130 shown in FIG. 23 has a p-channel TFT 131 as the drive transistor, an n-channel TFT 132 as a first switch, a TFT 133 as a second switch, a TFT 134 as a third switch, a TFT 135 as a fourth switch, a capacitor C131, an organic EL light emitting-element 136 of a light emitting element OLED (electro-optical element), and nodes ND131 to ND133.

In FIG. 23, "SGL101" indicates the signal line, "SCNL101" indicates the scan line, "AZL101" indicates the auto-zero line, and "DRVL101" indicates the drive line respectively.

A source of the TFT 131 as the drive transistor is connected to the node ND133 (a connection point between a source of the TFT 133 and a drain of the TFT 134), and a drain of the same is connected to an anode side of the organic EL light emitting element 136. A cathode of the light emitting element 136 is connected to the second reference potential (for example, a grand potential).

A source of the TFT 133 is connected to the node ND133 (a source of the TFT 131), a drain of the same is connected to a supply line of the power source voltage VDD as the first reference potential, and a gate of the same is connected to the drive line DRVL101.

A drain of the TFT 134 is connected to the node ND133 (a source of the TFT 131), a source of the same is connected to the node ND131 (a source of the TFT 132), and a gate of the same is connected to the auto-zero line AZL101.

A first electrode of the capacitor C131 is connected to the node ND131, and a second electrode of the same is connected to the node ND132.

A source of the TFT 132 is connected to the node ND131, a drain of the same is connected to the signal line SGL101, a gate of the same is connected to the scan line SCNL101 arranged in the first row.

A source of the TFT 135 is connected to the node ND132 (a gate of the TFT 131), and a drain of the same is connected to the precharged potential vofs.

Below, an operation of the pixel circuit 130 will be explained with reference to the timing charts shown in FIGS. 24A to 24D.

Step ST11

When the drive control including the correction processing is performed, as shown in FIGS. 24C and 24D, the drive line DRVL101 and the auto-zero line AZL101 are set at the high level to make the TFT 133, the TFT 134, and the TFT 135 the conductive states.

At this time, the-gate of the TFT 131 is applied with the precharged potential Vpc by the TFT 135, and an input side potential VC131 of the capacitor C131 rises up to the power source potential VDD or the vicinity of the same due to the TFT 133 and the TFT 134 being at the conductive states.

Step ST12

As shown in FIG. 24D, the drive line DRVL101 is set at the low level to make the TFT 132 the non-conductive state. Since the current flowing into the TFT 131 is cut off, the drain potential of the TFT 131 falls, the TFT 131 becomes the non-conductive state when the potential falls up to "Vpc+|Vth|", then the potential is stabilized.

At this time, the input side potential VC131 of the capacitor C131 retains "Vpc+|Vth|" due to the TFT 134 being at the conductive state. Here, "|Vth|" indicates the absolute value of the threshold of the TFT 131.

Step ST13

As shown in FIG. 24C, the auto-zero line AZL101 is set at the low level to make the TFT 134 and the TFT 135 the non-conductive states. A potential VC131 of an input side node of the capacitor C131 is "Vpc+|Vth|", and a gate potential Vg131 of the TFT 131 is "Vpc". Namely, a potential difference between terminals of the capacitor C131 becomes "|Vth|".

Step ST14

As shown in FIGS. 24B and 24A, the scan line SCNL101 is set at the high level to make the TFT 132 the conductive state, and a potential Vdata based on luminance data is applied from the signal line SGL101 to the input side node ND131 of the capacitor C131.

The potential difference between the terminals of the capacitor C131 is retained to "|Vth|", so the gate potential Vg131 of the TFT 131 becomes "Vdata−|Vth|".

Step ST15

As shown in FIGS. 24B and 24D, the scan line SCNL101 is set at the low level to make the TFT 132 the non-conductive state, and the drive line DRVL101 is set at the high level to make the TFT 133 the conductive state, so a current flows into the TFT 131 and the light emitting element (OLED) 136 and OLED starts to emit light.

Note that, although it is demanded to set a value of "Vpc" so as to be "Vpc+|Vth|<VDD" in the operations of the step ST11 and step 12 described above, the value can be determined arbitrarily as long as the above condition is satisfied.

A current Ioled flowing into the light emitting element (OLED) 136 after performing the above operation is calculated, and it may be expressed by the following formula if the TFT 131 operates in a saturation region.

$$\begin{aligned} Ioled &= \mu \mathrm{Cox} W/L/2\,(Vgs - Vth)^2 \\ &= \mu \mathrm{Cox} W/L/2\,(Vcc - Vg - |Vth|)^2 \\ &= \mu \mathrm{Cox} W/L/2\,(Vcc - Vdata + |Vth| - |Vth|)^2 \\ &= \mu \mathrm{Cox} W/L/2\,(Vcc - Vdata)^2 \end{aligned} \tag{9}$$

Here, "μ" indicates a mobility of a carrier, "Cox" indicates a gate capacity per a unit area, "W" indicates a gate width, and "L" indicates a gate length.

According to the formula (9), the current-Ioled does not depend on the threshold Vth of the TFT 131, and is controlled by "Vdata" given from an external.

In other words, by employing the pixel circuit 130 shown in FIG. 23, a display device being not affected by "Vth" varying in each pixel and having relatively high uniformity of both current and luminance, can be realized.

When the TFT 131 operates in a linear region, the current Ioled flowing into the light emitting element (OLED) 136 is expressed by the following, and does not depend on "Vth".

$$\begin{aligned} Ioled &= \mu \mathrm{Cox} W/L/\{(Vgs - Vth)Vds - Vds^2/2\} \\ &= \mu \mathrm{Cox} W/L/\{(Vcc - Vg - |Vth|)(Vcc - Vd) - (Vcc - Vd)^2/2\} \\ &= \mu \mathrm{Cox} W/L/\{(Vcc - Vdata + |Vth| - |Vth|)(Vcc - Vd) - \\ &\quad (Vcc - Vd)^2/2\} \\ &= \mu \mathrm{Cox} W/L/\{(Vcc - Vdata)(Vcc - Vd) - (Vcc - Vd)^2/2\} \end{aligned} \tag{10}$$

Here, "Vd" indicates a drain potential of the TFT 131.

When a drive control not including the correction processing is performed, as shown in FIGS. 24C and 24D, the drive line DRVL101 is set at the high level to make the TFT 133 the conductive state, and the auto-zero line AZL101 is set at the low level to make the TFT 134 and the TFT 135 the non-conductive states. At this time, the TFT 131 with a diode connected is connected to the light emitting element (OLED) 136, so the constant current Iref flows into the TFT 131.

At this time, the node ND131 is not precharged and the offset-channel correction (auto-zero operation) is not performed, and a control of the emitting light of the light emitting element 136 is performed during the usual write period and drive period.

Figure 1:
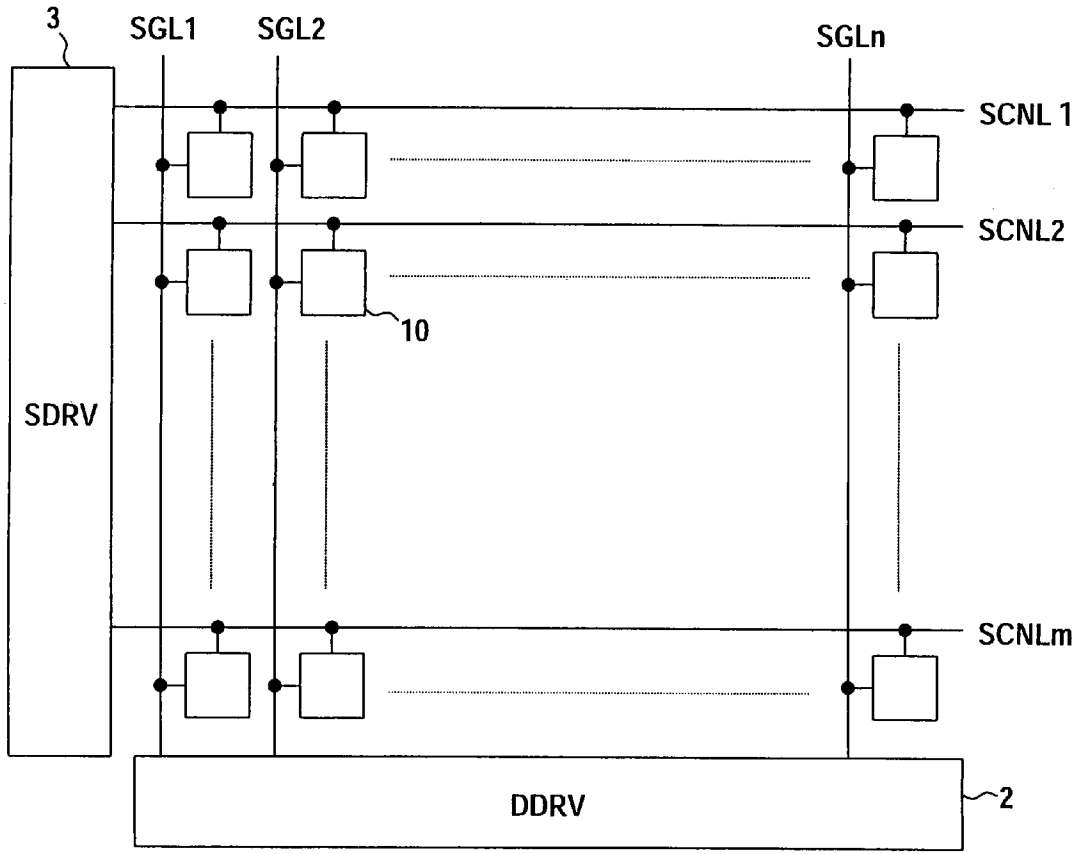
FIG. 1 is a block diagram illustrating a usual active matrix organic EL display (display device)
Figure 2:
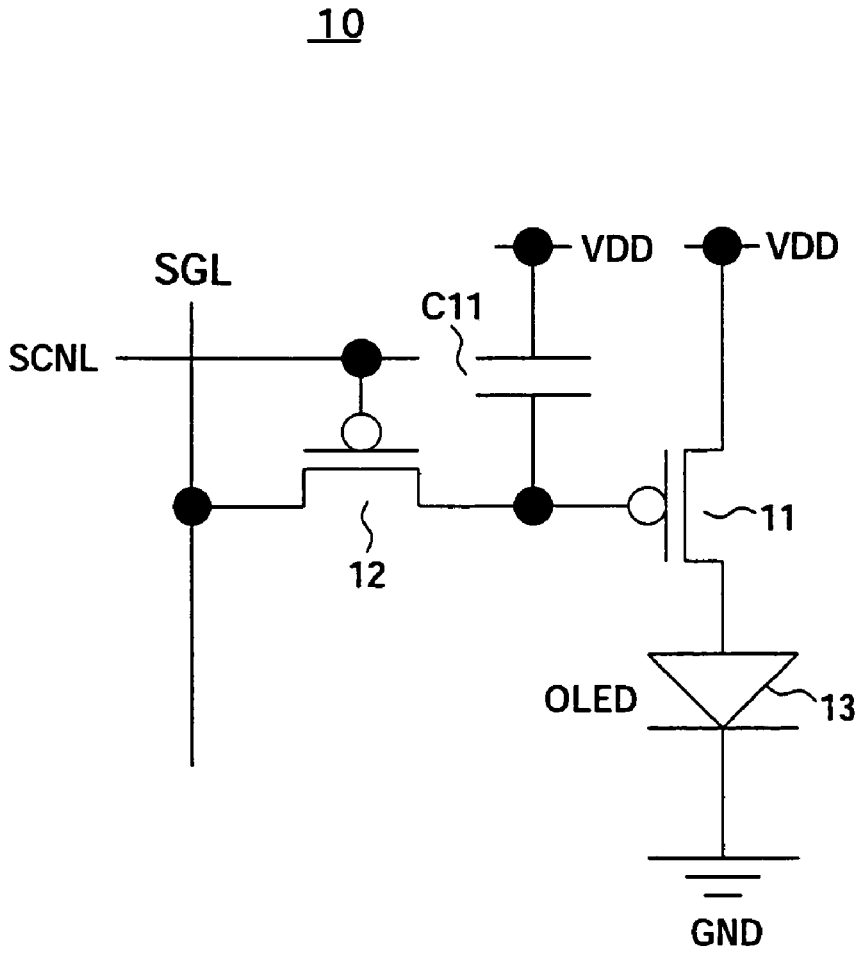
FIG. 2 is a circuit diagram illustrating an example of a first configuration of a pixel circuit in the related art.

As described above, according to the pixel circuit 130 shown in FIG. 23, a point where an influence of the variation of threshold Vth can be cancelled is superior to the circuit shown in FIG. 2.

The following points are superior to the circuit shown in FIG. 3.

Firstly, although the circuit shown in FIG. 3 suffers from a disadvantage that a gate amplitude ΔVg of the drive transistor falls in accordance with the above formula (2) compared with a data amplitude ΔVdata driven from the external, the data amplitude is approximately the same as the gate amplitude in the present invention, therefore, the pixel circuit can be driven by smaller signal line amplitude.

Therefore, a lower power consumption and a low noise drive are possible.

Secondly, in a coupling capacitance between the auto-zero line and the gate of the TFT, which is disadvantage in the circuit shown in FIG. 3, the TFT 134 is not directly connected to the gate of the TFT 131 in the pixel circuit 130 shown in FIG. 23, which is hardly affected by the capacitance couple.

On the other hand, although the TFT 135 is connected to the gate of the TFT 131, a source of the TFT 135 is connected to the constant potential Vpc, so the gate potential of the TFT 131 is retained to about the potential of "Vpc" when the gate potential changes at a time where the auto-zero operation is ended.

In this way, the pixel circuit 130 shown in FIG. 23 is hardly affected between the auto-zero line AZL101 and the gate of the TFT 131, and performs the correction of the variation of "Vth" accurately compared with the pixel circuit shown in FIG. 3.

Namely, according to the pixel circuit shown in FIG. 23, a predetermined current is accurately supplied to the light emitting element of the pixel circuit, and does not depend on the variation of the threshold of the transistor, as a result, the organic EL pixel circuit capable of displaying an image having a high uniformity in luminance and a high image quality can be realized. As a result, a highly accurate threshold correction is possible compared with a similar circuit in the related art.

According to the organic EL displays 100D and 100E employing the pixel circuit 130, the same effect as those of the above first to fourth embodiments can be obtained.

When the drive control not including the correction processing is performed, the timing where the TFT 132 is turned on can be advanced by the scan line SCNL101, therefore, the drive control operation can be performed at high speed.

Note that, the pixel circuit 130 shown in FIG. 23 is an example and the present invention is not limited thereto. For example, as described above, the TFT 132 to TFT 135 are mere switches, so it is obvious that a part of TFTs or the entire TFT can be formed by a p-channel element or other switch elements.

Figure 25:
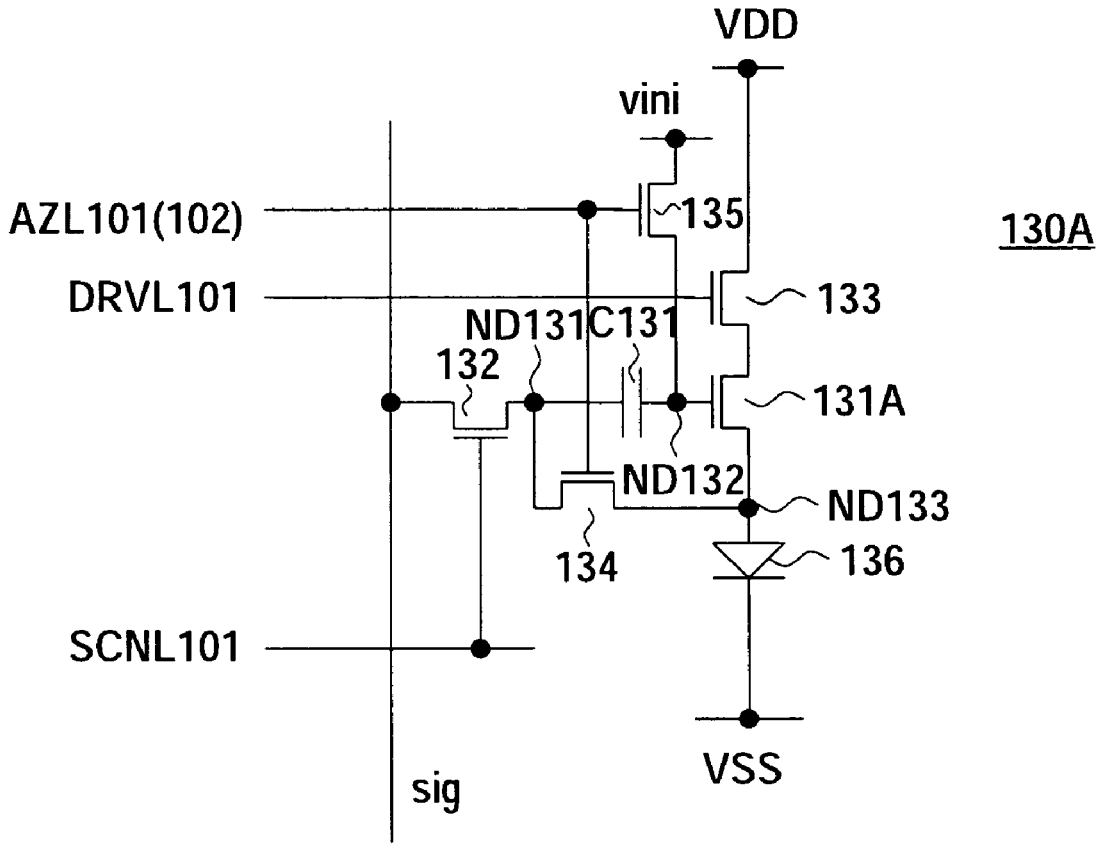
FIG. 25 is a circuit diagram illustrating a third example of a specific pixel circuit capable of being applied to the organic EL displays shown in FIG. 19 and FIG. 20.

FIG. 25 is a circuit diagram illustrating a third example of a specific pixel circuit capable of being applied to the organic EL displays shown in FIG. 19 and FIG. 20.

Figure 26:
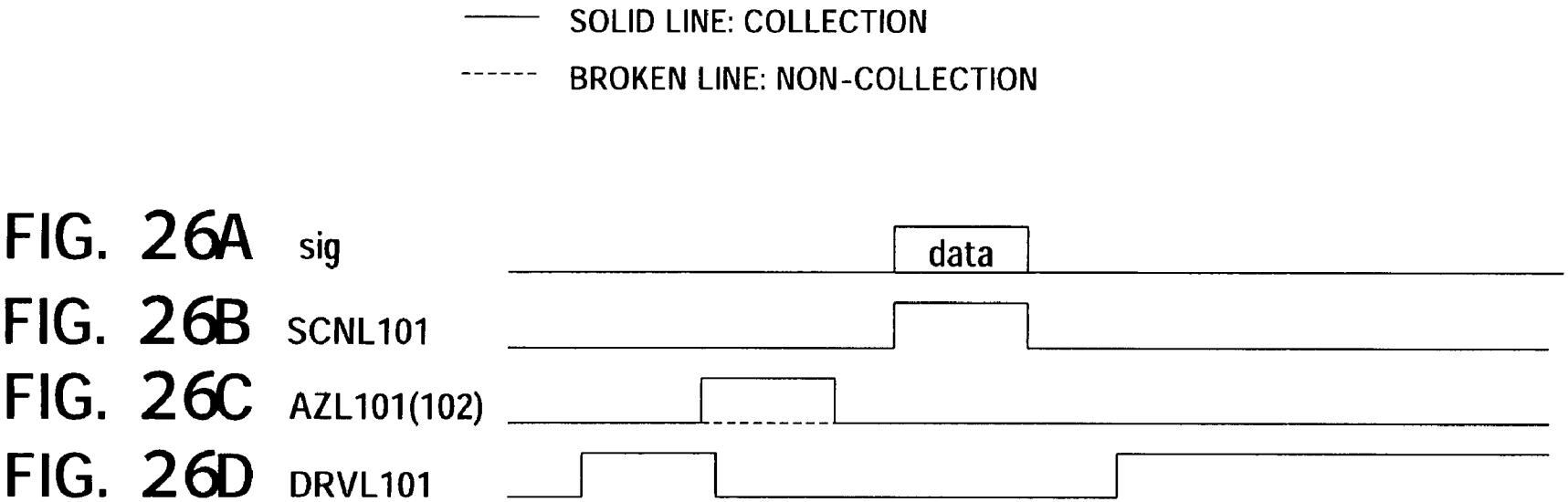
FIGS. 26A to 26D are timing charts for a basic operation, including a correction and a non-correction, of the pixel circuit shown in FIG. 25.

FIGS. 26A to 26D are timing charts for a basic operation, including a correction and a non-correction, of the pixel circuit shown in FIG. 25. In FIG. 26C, a solid line indicates a timing where the correction is performed and a broken line indicates a timing where the correction is not performed.

A different point of the pixel circuit 130A shown in FIG. 25 from the pixel circuit 130 shown in FIG. 23 resides in that the drive transistor is formed by an n-channel TFT 131A instead of the p-channel TFT 131, and a source of the TFT 131A is connected to an anode of the light emitting element 136, a connection point thereof is determined as a node ND133, and a source and a drain of the TFT 134 are respectively connected between a gate and a source of the TFT 131A (between the nodes ND132 and ND133), thereby a so-called source follower formation is formed.

Other components are the same way as the circuit shown in FIG. 23, the basic operation is also the same way, appearing from the timing charts of FIGS. 24A to 24D and FIGS. 26A to 24D, and explanations thereof are omitted.

According to the organic EL displays 100D and 100E employing the pixel circuit 130A, the same effect as those of the first to fourth embodiments described above can be obtained.

When the drive control not including the correction processing is performed, a timing where the TFT 132 is turned on is also able to be advanced by the scan line SCNL101, therefore, the drive control operation can be performed at high speed.

Figure 27:
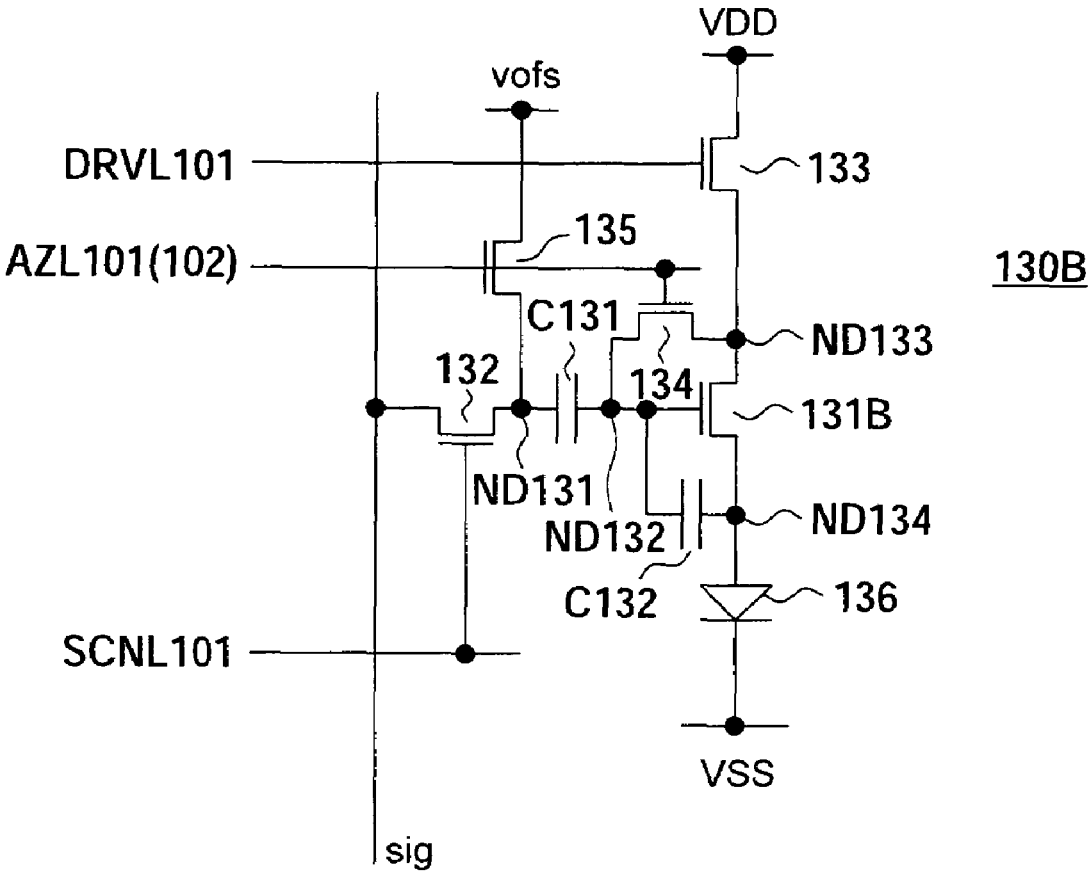
FIG. 27 is a circuit diagram illustrating a fourth example of a specific pixel circuit capable of being applied to the organic EL displays shown in FIG. 19 and FIG. 20.

FIG. 27 is a circuit diagram illustrating a fourth example of a specific pixel circuit capable of being applied to the organic. EL displays shown in FIG. 19 and FIG. 20.

Figures 28, 28A, 28B, 28C, 28D:
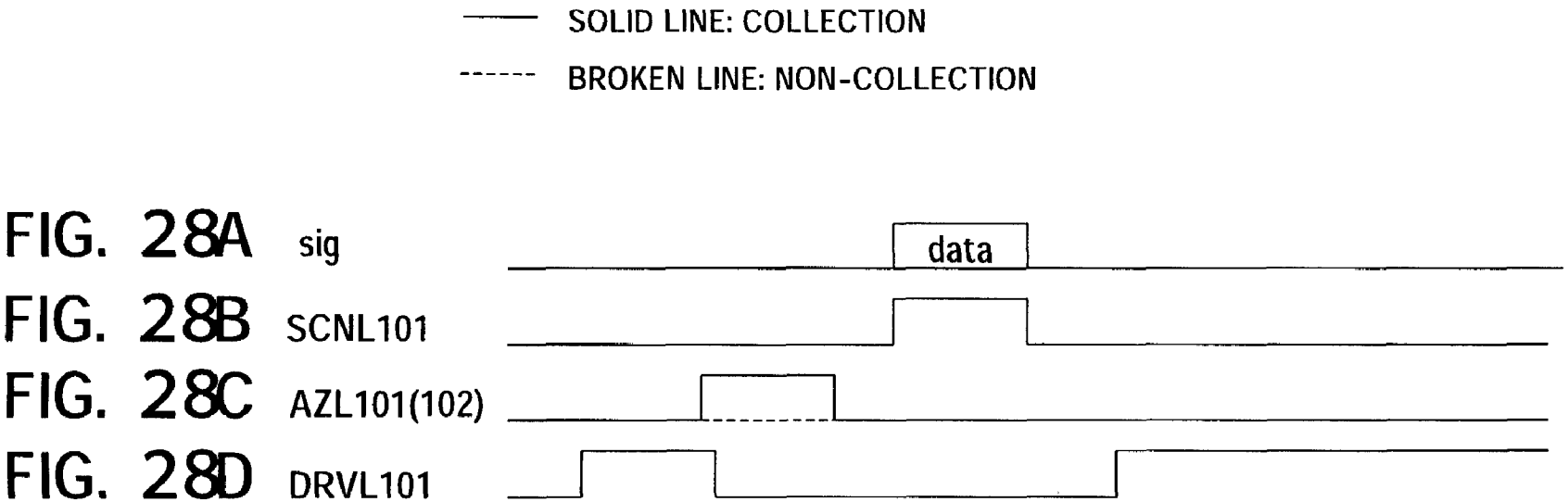
FIGS. 28A to 28D are timing charts for a basic operation, including a correction and a non-correction, of the pixel circuit shown in FIG. 27.

FIGS. 28A to 28D are timing charts for a basic operation, including a correction and a non correction, of the pixel circuit shown in FIG. 27. In FIG. 28C, a solid line indicates a timing where the correction is performed and a broken line indicates a timing where the correction is not performed.

A different-point of the pixel circuit 130B shown in FIG. 27 from the pixel circuit 130 shown in FIG. 23 resides in that the drive transistor is formed by an n-channel TFT 131B instead of the p-channel TFT 131 and the capacitor C132 is connected between the node ND134 and the node ND132, thereby a so-called bootstrap formation is formed.

Other components are the same way as those of the circuit shown in FIG. 23, the basic operation is also the same way appearing from the timing charts of FIGS. 24A to 24D and FIGS. 28A to 28D, and explanations thereof are omitted.

According to the organic EL displays 100D and 100E employing the pixel circuit 130B, the same effect as those of the first to fourth embodiments described above can be obtained.

When the drive control in which the correction processing is not performed is performed, a timing where the TFT 132 is turned on is also able to be advanced by the scan line SCNL101, therefore, the drive control operation can be performed at high speed.

According to embodiments of the present invention, a low power consumption with the uniformity of luminance retained is possible. And a high contrast is realized, so an organic EL display or other display devices having a high image quality can be realized.

It should be understood by those skilled in the art that various modifications, combinations, sub-combinations and alterations may occur depending on design requirements and other factors in so far as they are within scope of the appeared claims or the equivalents thereof.

What is claimed is:

1. A pixel circuit comprising:

an electro-optical element changing a luminance changes based on a flowing current, a signal line supplied with a data signal corresponding to at least a luminance information;

a first control line;

a drive transistor forming a current supply line between a first terminal and a second terminal and controlling a current, flowing into the current supply line, based on a potential of a control terminal;

a node electrically couplable to the control terminal of the drive transistor; and a first switch connected between the signal line and the node and controlled with a conductive state and a non-conducive state by the first control line, wherein during a frame, the pixel circuit is able to set a correction period for correcting a variation of property of the drive transistor in a pixel, a write period for driving the first switch by the first control line and writing the data signal from the signal line to the node, and a drive period for storing the written data signal and driving the electro-optical element, and the pixel circuit is driven and controlled so that an interval having the correction period, the write period, and the drive period are carried out, and an interval having the write period and the drive period without the correction period exist.

2. A pixel circuit as set forth in claim 1, wherein a coupling capacitance is connected between the node and the control terminal of the drive transistor, and a voltage depending on a threshold voltage of the drive transistor is accumulated during the correction period at a both ends of the coupling capacitance.

3. A pixel circuit as set forth in claim 1, wherein the correction period is set once per a plurality of a frame.

4. A pixel circuit as set forth in claim 1, wherein the correction period is set once per a plurality of a field.

5. A pixel circuit as set forth in claim 1, wherein an existence of the correction period is controlled in a plurality of row units.

6. A pixel circuit as set forth in claim 1, wherein an existence of the correction period is controlled each in an odd numbered scan line unit and an even numbered scan line unit.

7. A pixel circuit as set forth in claim 1, wherein an existence of the correction period is controlled in a plurality of column units.

8. A pixel circuit as set forth in claim 1, wherein an existence of the correction period is controlled each in an odd numbered signal line unit and an even numbered signal line unit.

9. A pixel circuit as set forth in claim 1, wherein an existence of the correction period is controlled in an adjoining pixel unit.

10. A display device comprising:

a plurality of a pixel circuit arranged in matrix;

a signal line interconnected in each column with respect to a matrix arrangement of the pixel circuit and supplied with a data signal corresponding to at least a luminance information;

a first control line interconnected in each row with respect to a matrix arrangement of the pixel circuit; and a drive unit, the pixel circuit including an electro-optical element changing a luminance based on a flowing current, a signal line supplied with the data signal corresponding to at least the luminance information, a drive transistor forming a current supply line between a first terminal and a second terminal and controlling a current, flowing into the current supply line, based on a potential of a control terminal, a node electrically couplable to the control terminal of the drive transistor, and a first switch connected between the signal line and the node and controlled with a conductive state and a non-conductive state by the first control line, wherein during a frame, the drive unit is able to set a correction period for correcting a variation of property of the drive transistor in a pixel, a write period for driving the first switch by the first control line and writing the data signal from the signal line to the node, and a drive period for storing the written data signal and driving the electro-optical element, and the drive unit drives and controls so that an interval having the correction period, the write period, and the drive period are carried out, and an interval having the write period and the drive period without the correction period exist.

11. A display device as set forth in claim 10, wherein a coupling capacitance is connected between the node and the control terminal of the drive transistor, and a voltage depending on a threshold voltage of the drive transistor is charged during the correction period at a both ends of the coupling capacitance.

12. A method for controlling a pixel circuit, having an electro-optical element changing a luminance based on a flowing current, a signal line supplied with a data signal corresponding to at least a luminance information, a first control line, a drive transistor forming a current supply line between a first terminal and a second terminal and controlling a current, flowing into the current supply line, based on a potential of a control terminal, a node capable of electrically coupling the control terminal of the drive transistor, and a first switch connected between the signal line and the node and controlled with a conductive state and a non-conductive state by the first control line, the method comprising the step of:

controlling the pixel circuit so that a correction period for correcting, a variation of property of the drive transistor in a pixel, a write period for driving the first switch by the first control line and writing the data signal from the signal line to the node, and a drive period for storing the written data signal and driving the electro-optical element are set during a frame, and an interval having the correction period, the write period, and the drive period, and an interval having the write period and the drive period without the correction period exist.

13. A method for controlling a pixel circuit as set forth in claim 12, wherein the correction period is set once per a plurality of the frame.

14. A method for controlling a pixel circuit as set forth in claim 12, wherein the correction period is set once per a plurality of a field.

15. A method for controlling a pixel circuit as set forth in claim 12, wherein an existence of the correction period is controlled in a plurality of row units.

16. A method for controlling a pixel circuit as set forth in claim 12, wherein an existence of the correction period is controlled each in an odd numbered scan line unit and an even numbered scan line unit.

17. A method for controlling a pixel circuit as set forth in claim 12, wherein an existence of the correction period is controlled in a plurality of column units.

18. A method for controlling a pixel circuit as set forth in claim 12, wherein an existence of the correction period is controlled each in an odd numbered signal line unit and an even numbered signal line unit.

19. A method for controlling a pixel circuit as set forth in claim 12, wherein an existence of the correction period is controlled in an adjoining pixel unit.

* * * * *